US010271701B2

(12) United States Patent
Hyun et al.

(10) Patent No.: US 10,271,701 B2
(45) Date of Patent: Apr. 30, 2019

(54) DUST COLLECTOR AND VACUUM CLEANER HAVING THE SAME

(71) Applicant: LG ELECTRONICS INC., Seoul (KR)

(72) Inventors: Kietak Hyun, Seoul (KR); Hyukjin Ahn, Seoul (KR); Hyungsoon Lee, Seoul (KR); Soohan Eo, Seoul (KR); Sangchul Lee, Seoul (KR); Jungmin Ko, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 189 days.

(21) Appl. No.: 15/487,821

(22) Filed: Apr. 14, 2017

(65) Prior Publication Data

US 2017/0296017 A1 Oct. 19, 2017

(30) Foreign Application Priority Data

Apr. 14, 2016 (KR) ..... 10-2016-0045744
Jun. 16, 2016 (KR) ..... 10-2016-0075244

(51) Int. Cl.
*A47L 9/10* (2006.01)
*A47L 9/16* (2006.01)
(Continued)

(52) U.S. Cl.
CPC ..... *A47L 9/1608* (2013.01); *A47L 5/362* (2013.01); *A47L 9/127* (2013.01); *A47L 9/165* (2013.01);
(Continued)

(58) Field of Classification Search
CPC ..... A47L 5/362; A47L 9/127; A47L 9/1608; A47L 9/1633; A47L 9/1641; A47L 9/165;
(Continued)

(56) References Cited

U.S. PATENT DOCUMENTS 8,209,815 B2 7/2012 Makarov et al.
8,679,211 B1 * 3/2014 Makarov ..... A47L 9/1641 55/343
(Continued)

FOREIGN PATENT DOCUMENTS

CA 2 986 312 9/2011
CN 101816537 9/2010
(Continued)

OTHER PUBLICATIONS

Korean Notice of Allowance dated Dec. 28, 2017 issued in Application No. 10-2016-0045744.
(Continued)

*Primary Examiner* — Frank M Lawrence, Jr.
(74) *Attorney, Agent, or Firm* — KED & Associates, LLP

(57) ABSTRACT

A dust collector includes a primary cyclone unit to separate dust from air introduced from outside dust collector and a secondary cyclone unit includes axial cyclones which separate fine dust from air introduced in an axial direction. The secondary cyclone unit includes a first group of axial cyclones disposed along a circumference of a first circle so as to contact an inner circumferential surface of an inner case, and formed to be partially spaced apart from the inner circumferential surface of the inner case to form first passages therebetween; and a second group of axial cyclones disposed to contact each other along a circumference of a second circle concentric with the first circle and smaller than the first circle, and formed to contact some of the first group of axial cyclones and to be spaced apart from others of the first group axial cyclones to form second passages therebetween.

20 Claims, 10 Drawing Sheets

(51) Int. Cl.

| | |
|---|---|
| ***A47L 5/36*** | (2006.01) |
| ***A47L 9/12*** | (2006.01) |
| ***B04C 5/28*** | (2006.01) |
| ***B04C 5/081*** | (2006.01) |
| ***B04C 5/13*** | (2006.01) |
| ***B04C 9/00*** | (2006.01) |
| ***B04C 5/06*** | (2006.01) |
| ***B04C 5/103*** | (2006.01) |
| ***B04C 5/185*** | (2006.01) |
| ***B04C 7/00*** | (2006.01) |

(52) U.S. Cl.

CPC ..... *A47L 9/1633* (2013.01); *A47L 9/1641* (2013.01); *A47L 9/1666* (2013.01); *A47L 9/1683* (2013.01); *A47L 9/1691* (2013.01); *B04C 5/06* (2013.01); *B04C 5/081* (2013.01); *B04C 5/103* (2013.01); *B04C 5/13* (2013.01); *B04C 5/185* (2013.01); *B04C 5/28* (2013.01); *B04C 7/00* (2013.01); *B04C 9/00* (2013.01); *B04C 2009/004* (2013.01)

(58) Field of Classification Search

CPC .... A47L 9/1666; A47L 9/1683; A47L 9/1691; B04C 5/06; B04C 5/081; B04C 5/103; B04C 5/13; B04C 5/185; B04C 5/28; B04C 7/00; B04C 9/00; B04C 2009/004; B01D 45/12

USPC ..... 95/271; 55/345–349, 459.1, DIG. 3; 15/353

See application file for complete search history.

(56) References Cited

U.S. PATENT DOCUMENTS

| | | | | |
|---|---|---|---|---|
| 8,956,431 | B2 | 2/2015 | Ackermann et al. | |
| 2004/0068827 | A1* | 4/2004 | Dyson | A47L 5/28 15/353 |
| 2006/0130265 | A1* | 6/2006 | Oh | A47L 9/00 15/327.2 |
| 2009/0181841 | A1* | 7/2009 | Conrad | A47L 9/1625 494/32 |
| 2010/0218338 | A1 | 9/2010 | McLeod | |
| 2011/0219570 | A1 | 9/2011 | Conrad | |
| 2012/0284960 | A1* | 11/2012 | Sutton | A47L 9/1633 15/353 |
| 2013/0091660 | A1 | 4/2013 | Smith | |
| 2013/0291334 | A1* | 11/2013 | Peng | A47L 9/1625 15/353 |
| 2014/0096341 | A1 | 4/2014 | Conrad | |
| 2014/0366495 | A1 | 12/2014 | Stickney et al. | |

FOREIGN PATENT DOCUMENTS

| | | |
|---|---|---|
| CN | 102740753 | 10/2012 |
| CN | 104125790 | 10/2014 |
| KR | 10-2001-0034704 | 4/2001 |
| KR | 10-2006-0118801 | 11/2006 |
| KR | 10-0647197 | 11/2006 |
| KR | 10-0673769 | 1/2007 |
| KR | 10-2007-0101056 | 10/2007 |
| KR | 10-2010-0051320 | 5/2010 |
| KR | 10-2011-0122698 | 11/2011 |
| KR | 10-2014-0104012 | 8/2014 |
| KR | 10-2016-0038570 | 4/2016 |
| WO | WO 2012/153095 | 11/2012 |

OTHER PUBLICATIONS

International Search Report and Written Opinion dated Jul. 11, 2017 issued in Application No. PCT/KR2017/004012.

International Search Report and Written Opinion dated Jul. 11, 2017 issued in Application No. PCT/KR2017/004015.

Korean Office Action dated Jul. 18, 2017 issued in Application No. 10-2016-0045744.

Taiwanese Decision to Grant a Patent dated Jun. 19, 2018 issued in Application No. 106112428 (with English translation).

U.S. Appl. No. 15/487,756, filed Apr. 14, 2017.

Taiwanese Office Action dated Oct. 18, 2017 issued in Application No. 106112429.

* cited by examiner

DUST COLLECTOR AND VACUUM CLEANER HAVING THE SAME

CROSS-REFERENCE TO RELATED APPLICATIONS

This application claims priority under 35 U.S.C. § 119 to Korean Application No. 10-2016-0045744, filed on Apr. 14, 2016, and No. 10-2016-0075244, filed on Jun. 16, 2016, whose entire disclosures are herein incorporated by reference.

BACKGROUND

1. Field

This specification relates to a dust collector for a vacuum cleaner, capable of separating debris and/or dust from sucked air by using a multi-cyclone.

2. Background

A vacuum cleaner may include an apparatus capable of discharging clean air by sucking air by a suction force, and by separating debris and/or dust from the sucked air. The vacuum cleaner may be categorized into a canister type, an upright type, a hand type, a cylinder floor type, etc. The canister type vacuum cleaner may include a suction nozzle and a cleaner body communicating with each other by a connection member. The upright type vacuum cleaner may include a suction nozzle and a cleaner body are integrally formed with each other.

A cyclone used in the vacuum cleaner may be categorized into a vertical cyclone and an axial cyclone according to an air inflow direction. A structure of the vertical cyclone has been disclosed in Korean Registration Patent Publication No. 10-0673769. A structure of the axial cyclone has been disclosed in Korean Patent Publication No. 10-2010-0051320.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1A:
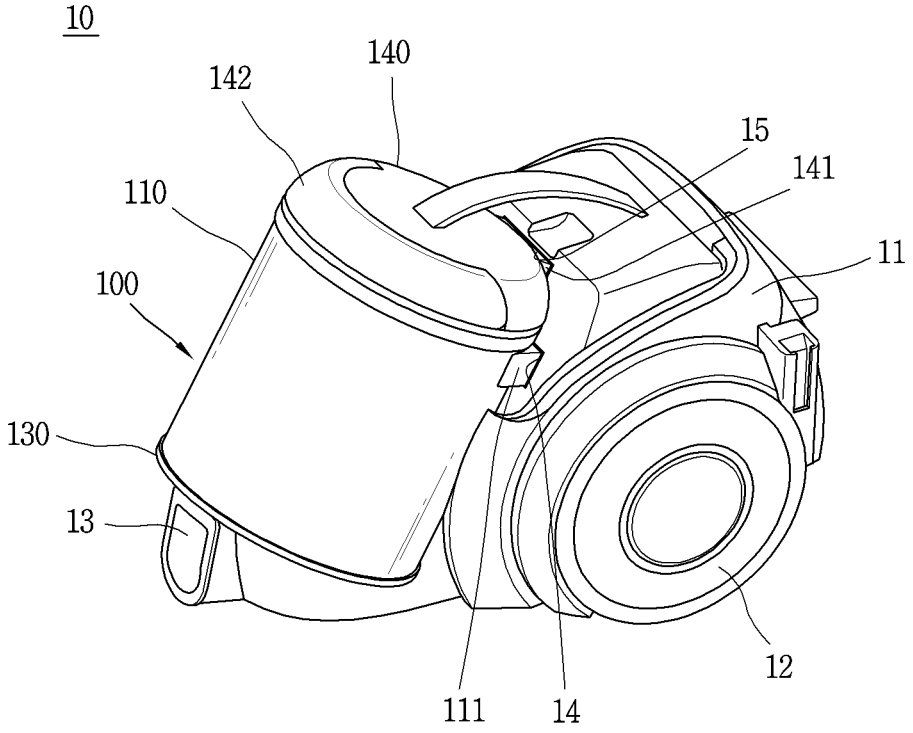
FIG. 1A is a perspective view illustrating an example of a vacuum cleaner according to certain implementations.

FIG. 1A is a perspective view illustrating an example of a vacuum cleaner 10 according to certain implementations. A cleaner body 11 and a dust collector or dust bin 100 forms appearance of the vacuum cleaner 10. Wheels 12 are provided at both sides of the cleaner body 11 for movements of the cleaner body 11. A suction motor, and a suction fan, which is rotated by the suction motor to generate a suction force, are installed in the cleaner body 11.

The vacuum cleaner 10 may further include a suction nozzle configured to suck air including foreign materials, and a connection member configured to connect the suction nozzle to the cleaner body 11. In in certain implementations, a basic configuration of the suction nozzle and the connection member is known to one of ordinary skill in the art, and thus its detailed explanations will be omitted.

A suction port 13, configured to suck air sucked through the suction nozzle and foreign materials included in the air, is formed at a lower end of a front surface of the cleaner body 11. Air and foreign materials are sucked to the suction unit 13 as the suction motor and the suction fan operate. The air and the foreign materials sucked to the suction unit 13 are introduced into the duct collector 100, through a side inlet passage 14 inside the vacuum cleaner and an inlet 111 of the dust collector 100, and then are separated from each other in the dust collector 100. And the air separated from the foreign materials is discharged from the dust collector 100, through an outlet 141 of the dust collector 100 and a side outlet passage 15 inside the vacuum cleaner.

For reference in this specification, foreign materials included in air may be classified into debris, dust, fine dust, and ultrafine dust. Dust having relatively larger particles is referred to as 'dust', dust having relatively smaller particles is referred to as 'fine dust', and dust having even smaller particles than the fine dust is referred to as 'ultrafine dust'.

The dust collector 100 is formed to be detachably mounted to the cleaner body 11. The dust collector 100 is configured to collect dust by separating foreign materials from sucked air, and to discharge the air with foreign materials removed therefrom.

An opening may be formed at each of an upper end and a lower end of an outer case 110. A lower cover 130 is coupled to the lower end of the outer case 110, and an upper cover 140 is coupled to the upper end of the outer case 110. The lower cover 130 is installed to open and close the opening of the lower end of the outer case 110. The lower cover 130 may be detachably mounted to the outer case 110.

The upper cover 140 is installed to open and close the opening of the upper end of the outer case 110. The upper cover 140 may be detachably mounted to the outer case 110. A handle 142 is rotatably installed at the upper cover 140. A user may separate the dust collector 100 from the cleaner body 11, and then carry the dust collector 100 by holding the dust collector 100 after rotating the handle 142.

Figure 1B:
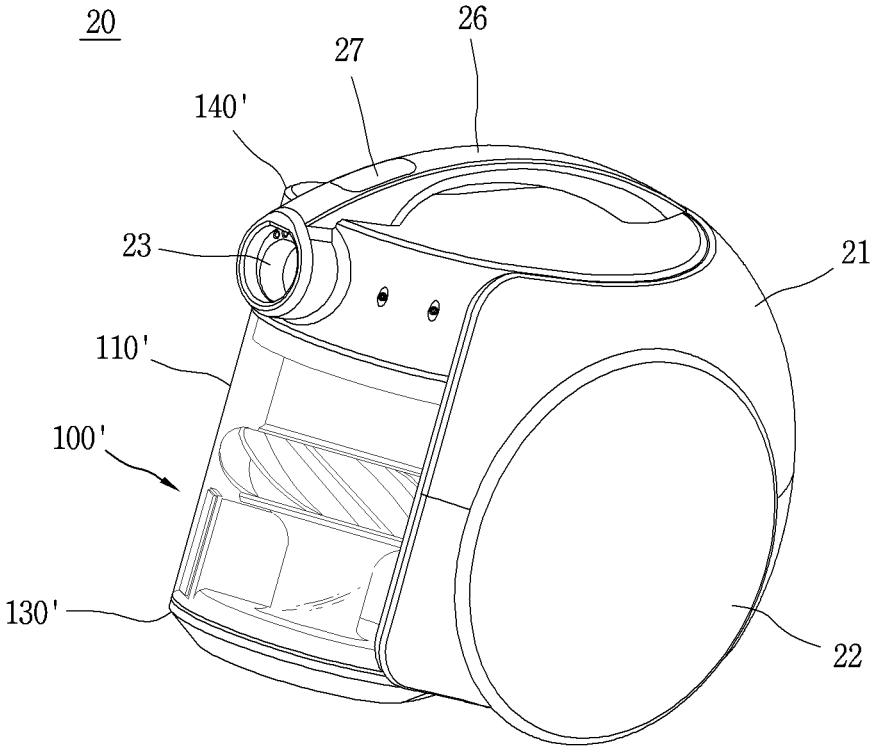
FIG. 1B is a perspective view illustrating another example of a vacuum cleaner according to certain implementations.

FIG. 1B is a perspective view illustrating another example of a vacuum cleaner 20 according to certain implementations. Unlike the vacuum cleaner 10 shown in FIG. 1A, the vacuum cleaner 20 of FIG. 1B has a configuration that an upper connector or port 23 is formed at an upper cover. Referring to FIG. 1B, an upper cover 140' and a lower cover 130' are coupled to an upper end and a lower end of an outer case 110', respectively. And the upper connector 23 is formed at one side of the upper cover 140'. Reference numeral 22 denotes a wheel. Other components may correspond to components described with reference to FIG. 1A.

It is possible that the upper connector 23 is formed at a cleaner body 21, not a dust collector 100'. For instance, a cover 140' of FIG. 1B, which covers an upper part of the dust collector, may be provided, and the upper connector 23 may be formed at the cover. In this case, the cover is connected to the cleaner body, not the dust collector. When the cover is upward pulled, the dust collector 100' may be separated from the cleaner body 21.

It is also possible that the upper connector 23 is formed at one end of a handle 26 to be explained later. In a state where the handle 26 is disposed to cover the dust collector 100', the upper connector 23 may be connected to an inlet of the dust collector 100'. When a suction nozzle is connected to the upper connector 23, the upper connector 23 forms an air passage between the inlet of the dust collector 100' and the suction nozzle.

The upper connector 23 is formed to be connectable with the suction nozzle. Unlike the vacuum cleaner 10 of FIG. 1A where air is sucked into the cleaner body 21 and then is introduced into the dust collector 100, the vacuum cleaner 20 of FIG. 1B is configured to directly suck air into the dust collector 100' through the suction nozzle and the upper connector 23.

A position of the inlet may be variable according to a design of the vacuum cleaners 10, 20 and the dust collectors 100, 100'. Whether to introduce air into the dust collector 100' through the cleaner body 21, or to directly introduce air into the dust collector 100' without through the cleaner body 21 may be determined according to the design. In certain implementations, the position of the inlet or whether to introduce air into the dust collector 100' through the cleaner body 21 or without through the cleaner body 21 is not limited.

The handle 26 installed at the cleaner body 21 may be formed to cover the upper cover 140' of the dust collector 100'. A button 27 is formed at the handle 26, and the button 27 is formed to release a locked state based on a user's pressing operation. The locked state means a fixed state of the dust collector 100' to the cleaner body 21. Once a user presses the button 27, the locked state is released and the upper cover 140' is open. As a result, the locked state of the dust collector 100' may be released, and the dust collector 100' may be separated from the cleaner body 21.

The dust collector 100, 200 of certain implementations will be explained in more detail. The dust collectors 100, 200 to be explained later are applied to a canister-type vacuum cleaner 10. However, certain implementations are not limited to this configuration. In other words, the dust collectors 100, 200 may be applied to an upright-type vacuum cleaner 10.

Figure 2:
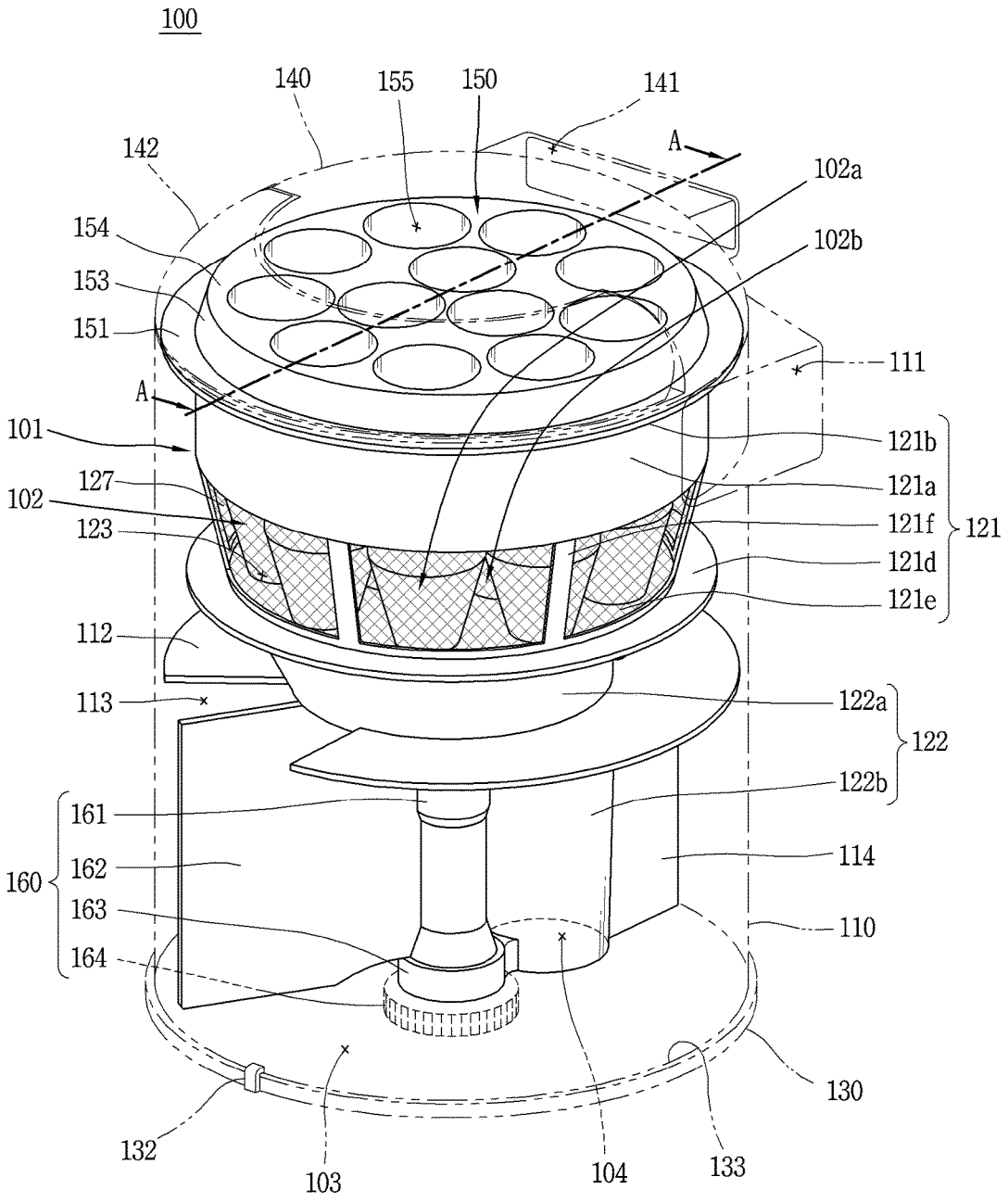
FIG. 2 is a view of a dust collector according to a first embodiment.

The appearance, or exterior surface, of the dust collector 100 is formed by the outer case 110, the lower cover 130 and the upper cover 140. The outer case 110 forms a side appearance of the dust collector 100, and forms an outer wall of a primary or first cyclone unit (or stage) 101. As shown in FIG. 2, the outer case 110 may be formed to have a cylindrical shape in order to form a vortex of the primary cyclone unit 101. In this case, unlike an inner circumferential surface of the outer case 110, an outer circumferential surface of the outer case 110 needs not be formed to have a cylindrical shape.

The inlet 111 of the dust collector 100 is formed at the outer case 110. Air and foreign materials introduced into the dust collector 100 through the suction unit 13 shown in FIG. 1 move along a passage inside the cleaner body 11, and are introduced into the outer case 110 through the inlet 111. The inlet 111 may be formed in a tangential direction of the outer case 110, and may be formed to extend towards an inner circumference of the outer case 110. The inlet 111 has such a structure for a vortex motion between air and foreign materials. Air and foreign materials, introduced into the outer case 110 through the inlet 111 in a tangential direction, perform a vortex motion in the outer case 110.

The inlet 111 may protrude from the outer case 110 so as to be connected to the passage inside the cleaner body 11. If the passage inside the cleaner body 11 has a shape corresponding to the outer circumferential surface of the outer case 110, the inlet 111 may not protrude from the outer case 110. An opening may be formed at each of an upper end and a lower end of an outer case 110. The lower cover 130 is coupled to the lower end of the outer case 110, and the upper cover 140 is coupled to the upper end of the outer case 110.

The lower cover 130 forms a bottom of the dust collector 100. A circumference of the lower cover 130 is formed to correspond to a circumference of the outer case 110, and the lower cover 130 is formed to cover the opening of the lower end of the outer case 110. The lower cover 130 may be rotatably coupled to the outer case 110, so as to open and close the opening of the lower end of the outer case 110. In this embodiment, the lower cover 130 is coupled to the outer case 110 by hinges 115, 131, thereby opening and closing the opening of the lower end of the outer case 110 by rotation. However, certain implementations are not limited to this configuration. That is, the lower cover 130 may be detachably mounted to the outer case 110.

The lower cover maintains its coupled state to the outer case 110 through a hook coupling portion or a latch 132. The hook coupling portion 132 is formed at an opposite side to a hinge 131, on the basis of the center of the lower cover 130. The hook coupling portion 132 is formed to be insertable into a groove 116 formed on the outer circumferential surface of the outer case 110. The hook coupling portion 132 may be withdrawn from the groove 116 of the outer case 110, for rotation of the lower cover 130 by the hinge 131.

A first dust collecting portion or chamber 103 and a second dust collecting portion or chamber 104, to be explained later, are formed inside the dust collector 100. The lower cover 130 is configured to form a bottom surface of each of the first and second dust collecting portions 103, 104. With such a configuration, the lower cover 130 may be rotated by the hinge 131, thereby simultaneously opening the first and second dust collecting portions 103, 104. Once the first and second dust collecting portions 103, 104 are simultaneously open as the lower cover 130 is rotated by the hinge 131, foreign particles may be simultaneously discharged. Since larger and smaller particles are simultaneously discharged through a single operation to open the lower cover 130, a user's convenience may be enhanced in using the dust collector 100, the vacuum cleaner 10, etc.

A sealing member or a gasket 133 may be coupled to the circumference of the lower cover 130. The sealing member 133 may be formed in a ring shape which encloses the circumference of the lower cover 130. The sealing member 133 is configured to prevent leakage of foreign particles collected in the dust collector 100, by sealing a space between the outer case 110 and the lower cover 130.

The upper cover 140 may be formed to cover the opening of the upper end of the outer case 110, and is coupled to an upper part of the outer case 110. A circumference of the upper cover 140 may be formed to correspond to the circumference of the outer case 110. The upper cover 140 is disposed to face a cover member 150 disposed in the outer case 110. The upper cover 140 is spaced from the cover member 150, and forms a discharge passage along which air discharged from a secondary cyclone unit (or stage) 102 to the outside of the dust collector 100. An outlet 141 of the dust collector 100 is formed at the upper cover 140, and air is discharged through the outlet 141.

The air discharged through the outlet 141 of the dust collector 100 may be discharge to the outside through a discharge opening of the cleaner body 11. A porous filter configured to filter ultrafine dust from air may be installed on a passage connected from the outlet 141 of the dust collector 100 to the discharge opening of the cleaner body 11.

The handle 142 may be rotatably coupled to the upper cover 140. The handle 142 may be formed along an outer circumference of the upper cover 140. For instance, as shown, the handle 142 may be formed in a semi-circular shape or an arch shape along the outer circumference of the upper cover 140. In case of separating the dust collector 100 from the cleaner body 11, a user may release a coupled state between the cleaner body 11 and the dust collector 100, and then lift the handle 142 by rotation.

A cyclone (or cyclone body) may be a device for separating foreign materials from air by a centrifugal force by forming a vortex of air and the foreign materials. The foreign materials include debris, dust, fine dust, ultrafine dust, etc. Since a weight of air and a weight of foreign materials are different from each other, a rotation radius of the air and a rotation radius of the foreign materials by a centrifugal force are different from each other. The cyclone is configured to separate foreign materials such as debris, dust and/or fine dust from air, by using a difference of rotation radiuses by a centrifugal force.

The primary cyclone unit (or first cyclone stage) 101 is formed in the outer case 110, and is configured to separate debris and/or dust from air introduced from outside. The primary cyclone unit 101 is formed by the outer case 110, inner cases 121, 122, and a mesh filter 127.

An inner circumferential surface of the outer case 110 forms an outer wall of the primary cyclone unit 101. Dust heavier than air, fine dust, etc. is rotated within a vortex with a rotation radius larger than that of air or fine dust. Since dust is rotated within a region defined by the inner circumferential surface of the outer case 110, a maximum rotation radius of dust is determined by the inner circumferential surface of the outer case 110.

The inner cases 121, 122 may be installed in the outer case 110, and may have a cylindrical shape, partially. Since the primary cyclone unit 101 is formed outside the inner cases 121, 122 and the secondary cyclone unit 102 is formed inside the inner cases 121, 122, the inner cases 121, 122 form a boundary between the primary cyclone unit 101 and the secondary cyclone unit 102. The inner cases 121, 122 are disposed directly below the cover member 150, and the cover member 150 is disposed to cover an open upper end of the inner cases 121, 122.

The inner cases 121, 122 may be formed as a first member (a frame) 121 and a second member 122 are coupled to each other, or may be formed as a single member. Hereinafter, certain implementations will be explained under an assumption that the inner cases 121, 122 are formed as the first member 121 and the second member 122 are coupled to each other. However, certain implementations are not limited to this configuration.

The first member 121 includes a lateral boundary portion 121*a* (a circular band), an upper boundary portion 121*b*, a skirt portion 121*d*, a plate portion 121*e*, and connection portions 121*f* (or ribs). The second member 122 will be explained with the first dust collecting portion 103 and the second dust collecting portion 104. The lateral boundary portion 121*a* is formed to enclose at least part of the secondary cyclone unit 102, and has a ring shape so as to accommodate therein axial cyclones (or cyclone bodies) 102*a*, 102*b* of the secondary cyclone unit 102. The lateral boundary portion 121*a* corresponds to a lateral boundary between the primary cyclone unit 101 and the secondary cyclone unit 102.

The upper boundary portion 121*b* extends in a circumferential direction, from an upper end of the lateral boundary portion 121*a* to an inner circumferential surface of the outer case 110. The upper boundary portion 121*b* contacts the inner circumferential surface of the outer case 110 in a circumferential direction, thereby forming an upper boundary of the primary cyclone unit 101. A sealing member or a gasket may be coupled to a circumference of the upper boundary portion 121*b*. The sealing member may be formed in a ring shape which encloses the circumference of the upper boundary portion 121*b*. The sealing member may be configured to prevent leakage of dust by sealing a space between the inner circumferential surface of the outer case 110 and the upper boundary portion 121*b*.

A protrusion 121*c* which faces the cover member is formed at the upper boundary portion 121*b*. The protrusion 121*c* is formed so as to be insertable into a groove 152 of the cover member, and the positions of the protrusion 121*c* and the groove 152 may be switched from each other. As the protrusion 121*c* of the upper boundary portion 121*b* is inserted into the groove 152 of the cover member 150, relative positions of the first member 121 and the cover member 150 may be set.

The skirt portion 121*d* extends in a circumferential direction, from a lower end of the first member 121 towards the inner circumferential surface of the outer case 110. The skirt portion 121*d* is configured to prevent scattering of dust separated from air by the primary cyclone unit 101. Unlike the upper boundary portion 121*b*, the skirt portion 121*d* is spaced from the inner circumferential surface of the outer case 110. As the skirt portion 121*d* is spaced from the inner circumferential surface of the outer case 110, a ring-shaped passage is formed between the inner circumferential surface of the outer case 110 and the skirt portion 121*d*. Dust and/or debris separated from air by the primary cyclone unit 101 moves to the first dust collecting portion 103 along the passage.

The plate portion 121*e* is formed inside the skirt portion 121*d*. A through hole 121*i*, configured to accommodate therein a lower end of the axial cyclones 102*a*, 102*b* (more specifically, a lower end of casing 125 to be explained later), is formed at the plate portion 121*e*. The plate portion 121*e* is configured to prevent fine dust discharged from a fine dust outlet 126*b* of the axial cyclones 102*a*, 102*b*, from being re-introduced into the secondary cyclone unit 102. The plate portion 121*e* and the skirt portion 121*d* may be formed at the same height, but certain implementations are not limited to this configuration.

One ends of the connection portions 121*f* are connected to the lateral boundary portion 121*a*, and another ends thereof are connected to the skirt portion 121*d* or the plate portion 121*e*. Said another ends of the connection portions 121*f* may be disposed at a boundary between the skirt portion 121*d* and the plate portion 121*e*. The connection portions 121*f* are spaced apart from each other along an outer circumference of the first member 121.

The lateral boundary portion 121*a* and the connection portions 121*f* may be formed to have a sectional surface narrowed toward the lower side in order to induce dropping of dust and/or debris separated from air by the primary cyclone unit 101. If the lateral boundary portion 121*a* and the connection portions 121*f* are formed in a vertical direction, they may serve as obstacles when dust drops. However, if the lateral boundary portion 121*a* and the connection portions 121*f* are formed to be inclined as shown, a smooth dropping of dust may be induced because they do not serve as obstacles when dust drops. A mesh filter 127 may be also formed to be inclined due to such reasons.

As the connection portions 121*f* are spaced apart from each other, openings 123 are formed at a region defined by the lateral boundary portion 121*a*, the connection portions 121*f*, and the skirt portion 121*d* (or the plate portion 121*e*). The mesh filter 127 is installed at the first member 121 so as to cover the openings 123. The mesh filter 127 may be provided in one or in plurality.

The mesh filter 127 is formed to have a net shape or a porous shape, in order to separate dust from air introduced into the inner cases 121, 122. Dust and fine dust may be distinguished from each other based on the mesh filter 127. That is, foreign materials having a particle size small enough to pass through the mesh filter 127 may be sorted as fine dust, whereas foreign materials having a particle size large enough not to pass through the mesh filter 127 may be sorted as dust and/or debris.

The first dust collecting portion 103 is formed to collect dust and/or debris separated from air by the primary cyclone unit 101. The first dust collecting portion 103 indicates a space defined by a partitioning portion or partition wall 112, the outer case 110, the inner cases 121, 122, and the lower cover 130. The partitioning portion 112, configured to partition an upper region and a lower region of the outer case 110 from each other, is formed in the outer case 110 along an inner circumferential surface of the outer case 110. The partitioning portion 112 may be integrally formed with the outer case 110.

The partitioning portion 112 forms an upper side wall of the first dust collecting portion 103. The partitioning portion 112 extends along the inner circumferential surface of the outer case 110. The partitioning portion 112 is provided with an opening 113 such that dust separated from air by the primary cyclone unit 101 is introduced into the first dust collecting portion 103.

Based on the partitioning portion 112, an upper region of the outer case 110 forms an outer wall of the aforementioned primary cyclone unit 101, and a lower region of the outer case 110 forms an outer wall of the first dust collecting portion 103. The outer wall of the first dust collecting portion 103, formed by the lower region of the outer case 110, corresponds to a side wall of the first dust collecting portion 103.

The second member 122 of the inner cases 121, 122 is disposed below the first member 121, and includes an accommodation portion 122*a* and a dust collecting portion boundary 122*b*. The accommodation portion 122*a* is configured to accommodate therein the fine dust outlet 126*b* of the axial cyclones 102*a*, 102*b*. An upper end of the accommodation portion 122*a* is open, and the plate portion 121*e* of the first member 121 is disposed to cover the open upper end of the accommodation portion 122*a*. The accommodation portion 122*a* is disposed on a pressing unit 160 to be explained later. The accommodation portion 122*a* may be also formed to be inclined, like the lateral boundary portion 121*a* or the connection portions 121*f* of the first member 121.

A bottom surface of the accommodation portion 122*a* forms an upper side wall of the first dust collecting portion 103, together with the partitioning portion 112. The partitioning portion 112 extends along an outer circumferential surface of the accommodation portion 122*a*, and an outer circumferential surface of the partitioning portion 112 is adhered with the outer circumferential surface of the accommodation portion 122*a*.

The dust collecting portion boundary 122*b* is formed as a hollow cylindrical shape or a hollow polygonal shape, and extends towards the lower cover 130 from one side of the accommodation portion 122*a*. The pressing unit 160 to be explained later is provided with a rotation shaft 161 disposed below the accommodation portion 122*a*. The dust collecting portion boundary 122*b* may be disposed at one side of the rotation shaft 161 in parallel. The rotation shaft 161 may be disposed at the center of the lower cover 130, and the dust collecting portion boundary 122*b* may be disposed to be eccentric from the center of the lower cover 130.

An outer circumferential surface of the dust collecting portion boundary 122*b* forms an inner wall of the first dust collecting portion 103. And the lower cover 130 forms a bottom surface of the first dust collecting portion 103. Accordingly, the first dust collecting portion 103 may be defined by the partitioning portion 112 and the accommodating portion 122*a* which form its upper side wall, the outer case 110 which forms its outer wall, the dust collecting portion boundary 122*b* which forms its inner wall, and the lower cover 130 which forms its bottom surface.

An inner wall 114 may be formed at the first dust collecting portion 103. The inner wall 114 may be integrally formed with the outer case 110, or may be integrally formed with the second member 122 of the inner cases 121, 122. The inner wall 114 extends in a vertical direction, so as to divide the left and right sides of the first dust collecting portion 103 from each other. One side of the inner wall 114 is connected to the outer case 110, and another side of the inner wall 114 is connected to the dust collecting portion boundary 122*b* of the second member 122. An upper end of the inner wall 114 may be connected to the partitioning portion 112, and a lower end of the inner wall 114 may contact the lower cover 130.

The first dust collecting portion 103 is formed to be open towards a lower region of the dust collector 100. A configuration to simultaneously open the first and second dust collecting portions 103, 104 by rotation of the lower cover 130 will be replaced by the aforementioned one.

If dust collected at the first dust collecting portion 103 scatters without being concentrated at one spot, the dust may scatter or may be discharged to an unintended place. Further, if dust collected at the first dust collecting portion 103 is not concentrated at one spot, it may be difficult to sufficiently obtain a dust collecting space. In order to solve such a problem, in certain implementations, a pressing unit 160 is used to pressurize dust collected at the first dust collecting portion 103 and to reduce a volume.

The pressing unit 160 is configured to compress collected dust by being rotated in two directions in the first dust collecting portion 103. The pressing unit 160 includes a rotation shaft 161, a pressing member 162, a fixing portion 163, a first driven gear 164, a power transmission rotation shaft 165, and a second driven gear 166. The rotation shaft 161 is disposed below the accommodating portion 122*a* of the second member 122. The rotation shaft 161 is formed to be rotatable by receiving a power from a driving motor of the cleaner body 11. The rotation shaft 161 is formed to reciprocate in two directions, i.e., in a clockwise direction or a counterclockwise direction. An upper part of the rotation shaft 161 may be supported by a lower part of the accommodating portion 122*a*, and a lower part of the rotation shaft 161 may be supported by the fixing portion 163.

A groove 161*a* inwardly recessed towards the center of the rotation shaft 161 is formed at the upper part of the rotation shaft 161. A protrusion 122*d* inserted into the groove 161*a* protrudes from the lower part of the accommodating portion 122*a*. As the protrusion 122*d* is inserted into the groove 161*a*, the rotation shaft 161 is supported. Accordingly, the protrusion 122*d* and the rotation shaft 161 are formed to be relatively rotatable with respect to each other. With such a structure, the protrusion 122*d* supports the center of the rotation shaft 161 when the rotation shaft 161 is rotated. This may allow the rotation shaft 161 to be rotated more stably.

The fixing portion 163 is coupled to the rotation shaft 161 so as to be relatively rotatable, and is fixed to the dust collecting portion boundary 122*b* of the inner cases 121, 122. Since the fixing portion 163 is connected to the inner cases 121, 122, the pressing member 162 and the rotation shaft 161 may be fixed to their own positions, even if the first dust collecting portion 103 is open as the lower cover 130 is rotated by the hinge 131.

The pressing member 162 is connected to the rotation shaft 161, and is formed to be rotated within the first dust collecting portion 103 as the rotation shaft 161 rotates. The pressing member 162 may be formed to have a plate shape. Dust collected at the first dust collecting portion 103 moves to one side of the first dust collecting portion 103 by rotation of the pressing member 162. When a large amount of dust is accumulated, the dust is pressurized to be compressed by the pressing member 162.

The first driven gear 164, the power transmission rotation shaft 165, and the second driven gear 166 are formed to transmit a driving force received from a driving motor of the cleaner body 11, to the rotation shaft 161. The driving motor is distinguished from the aforementioned suction motor.

The first driven gear 164 is disposed outside the lower cover 130, and is exposed to the outside of the dust collector 100. A driving gear corresponding to the first driven gear 164 is installed at the cleaner body 11. When the dust collector 100 is coupled to the cleaner body 11, the first driven gear 164 is engaged with the driving gear. The driving gear is formed to be rotated by the driving motor. Accordingly, a driving force generated as the driving motor operates is also transmitted to the first driven gear 164 through the driving gear. The power transmission rotation shaft 165 is connected to the first driven gear 164 and the second driven gear 166, respectively, through the lower cover 130. The power transmission rotation shaft 165 is formed to be relatively rotatable with respect to the lower cover 130.

The second driven gear 166 is connected to the power transmission rotation shaft 165, and is formed to transmit a driving force to the rotation shaft 161. A groove configured to accommodate the second driven gear 166 therein is formed at a lower end of the rotation shaft 161, and a gear structure engaged with the second driven gear 166 is provided at the periphery of the groove. The rotation shaft 161 and the second driven gear 166 are formed to be coupled to or separated from each other according to an open or closed state of the lower cover 130, thereby not interrupting an opening operation of the first and second dust collecting portions 103, 104.

The structure to transmit a driving force of the driving unit to the rotation shaft 161 may be variable according to a design change. For instance, the rotation shaft 161 may be penetratingly-formed at the lower cover 130, and may be directly engaged with the driving gear. Under any structure, a lower end of the pressing unit 160 should be formed to be relatively rotatable with respect to the lower cover 130. A sealing member for sealing a space between the pressing unit 160 and the lower cover 130 may be provided at a relative-rotation part of the lower cover 130.

Once the driving motor operates in a coupled state of the dust collector 100 to the cleaner body 11, a driving force is generated, and the driving gear is rotated by the generated driving force. The driving force transmitted to the driving gear of the cleaner body 11 is transmitted to the pressing unit 160. The first driven gear 164 is rotated in an engaged state with the driving gear, and the second driven gear 166 connected to the first driven gear 164 by the power transmission rotation shaft 165 is also rotated together with the first driven gear 164. The rotation shaft 161, formed to be rotated together with the second driven gear 166 is also rotated together with the second driven gear 166. And the pressing member 162 connected to the rotation shaft 161 is also rotated together with the rotation shaft 161. As a result, dust collected at the first dust collecting portion 103 is pressurized and compressed.

The driving motor may be controlled to rotate the pressing member 162 in two directions. For instance, the driving motor may be formed to be rotated in an opposite direction when a repulsive force is applied in an opposite direction to its rotation direction. That is, if the pressing member 162 is rotated in one direction to compress dust collected at one side to a predetermined level, the driving motor is rotated in another direction to compress dust collected at another side. The dust collector 100 and the cleaner may be designed such that a repulsive force may be generated when the pressing member 162 approaches or contacts an inner wall 114 to be explained later.

If a sufficient amount of dust has not been accumulated in the first dust collecting portion 103, the pressing member 162 may be rotated in an opposite direction by receiving a repulsive force by colliding with the inner wall 114, or by receiving a repulsive force by a stopper structure provided on its rotation path. As another example, a controller of the cleaner body 11 may apply a control signal to the driving motor such that a rotation direction of the pressing member 162 may be changed per predetermined time, and such that bi-directional rotations of the pressing member 162 may be performed repeatedly.

The inner wall 114, configured to collect dust which has moved to one side by rotation of the pressing member 162, may be provided in the first dust collecting portion 103. In this embodiment, the inner wall 114 is disposed on an opposite side to the rotation shaft 161, on the basis of the dust collecting portion boundary 122*b* of the second member 122. With such a configuration, dust introduced into the first dust collecting portion 103 is collected at both sides of the inner wall 114, by rotation of the pressing member 162. By the pressing unit 160, scattering of dust may be prevented, and discharge of dust to an unintended place may be significantly reduced.

Once debris and/or dust is separated from air by the primary cyclone unit 101, the air and fine dust are introduced into the secondary cyclone unit 102 along a path. The secondary cyclone unit 102 is configured to separate fine dust from the air introduced from the primary cyclone unit 101. The secondary cyclone unit 102 is formed by a set of axial cyclones 102*a*, 102*b* for separating fine dust from air introduced in an axial direction. The set of axial cyclones 102*a*, 102*b* includes casings 125 and a fine dust separating member 170.

The casings or inverted cones 125 form outer walls around hollow portions 125'. The outer walls around the hollow portions 125', formed by the casings 125, correspond to outer walls of the axial cyclones 102*a*, 102*b*. A vortex of air and fine dust is formed between vortex finders 171 to be explained later and the casings 125. Fine dust heavier than air is rotated within a vortex with a rotation radius larger than that of air. Since fine dust is rotated within a region defined by the casings 125, a maximum rotation radius of fine dust is determined by the respective casings 125.

The casing 125 may be formed in an inclined shape having a narrower area towards the lower side. The reason is in order to induce dropping of fine dust separated from air, and in order to prevent fine dust from being discharged to the vertex finder 171 along air.

A lower part of each of the casings 125 is supported by the plate portion 121*e* of the first member 121. Through holes 121*i* are formed at the plate portion 121*e* at positions facing the casings 125, and the lower part of each of the casings 125 is inserted into each of the through holes 121*i*. Since the lower part of the casing 125 is formed in an inclined shape having a narrower area towards the lower side, the casing 125 may be supported by the plate portion 121*e* at a position where an outer circumferential surface of the casing 125 has the same size as the through hole 121*i*.

An upper part of the casing 125 is formed to accommodate therein the vortex finder 171 of the fine dust separating member 170 to be explained later. The upper part of the casing 125 may be formed to have a predetermined inner diameter. The upper part and the lower part of the casing 125 may be distinguished from each other, based on a position where the inner diameter of the casing 125 is reduced. The fine dust outlet 126*b* is formed at a lower end of the casing 125. Fine dust separated from air is discharged from the axial cyclones 102*a*, 102*b*, through the fine dust outlet 126*b*.

The casings 125 are provided in the same number as the axial cyclones 102*a*, 102*b*. Since the set of the axial cyclones 102*a*, 102*b* is formed by the casings 125 and the fine dust separating member 170, the number of the axial cyclones 102*a*, 102*b* is the same as the number of the casings 125. For the same reason, the number of the vortex finders 171 and the number of band portions 172 each to be explained later are the same as the number of the axial cyclones 102*a*, 102*b*.

The casings 125 may be disposed inside the inner cases 121, 122. Referring to the drawings, the casings 125 are disposed inside the first member 121. The casings 125 may be divided into first group casings 125*a* and second group casings 125*b*. The first group casings 125*a* may be disposed to contact the inside of the first member 121, and the second group casings 125*b* may be disposed at an inner side of the first group casings 125*a* so as to be enclosed by the first group casings 125*a*.

The casings 125 may form a single member as an outer circumferential surface of each of the casings 125 is connected to other casings 125. Each of the casings 125 may be formed to have a circular sectional surface, such that a passage of air and fine dust is formed among the casings 125 even if the neighboring casings 125 contact each other. If the passage of air and fine dust is formed among the casings 125, an additional passage structure needs not be installed. However, each of the casings 125 may have a polygonal sectional surface. In this case, the polygonal sectional surface should be implemented such that a passage of air and fine dust may be formed.

Figure 4:
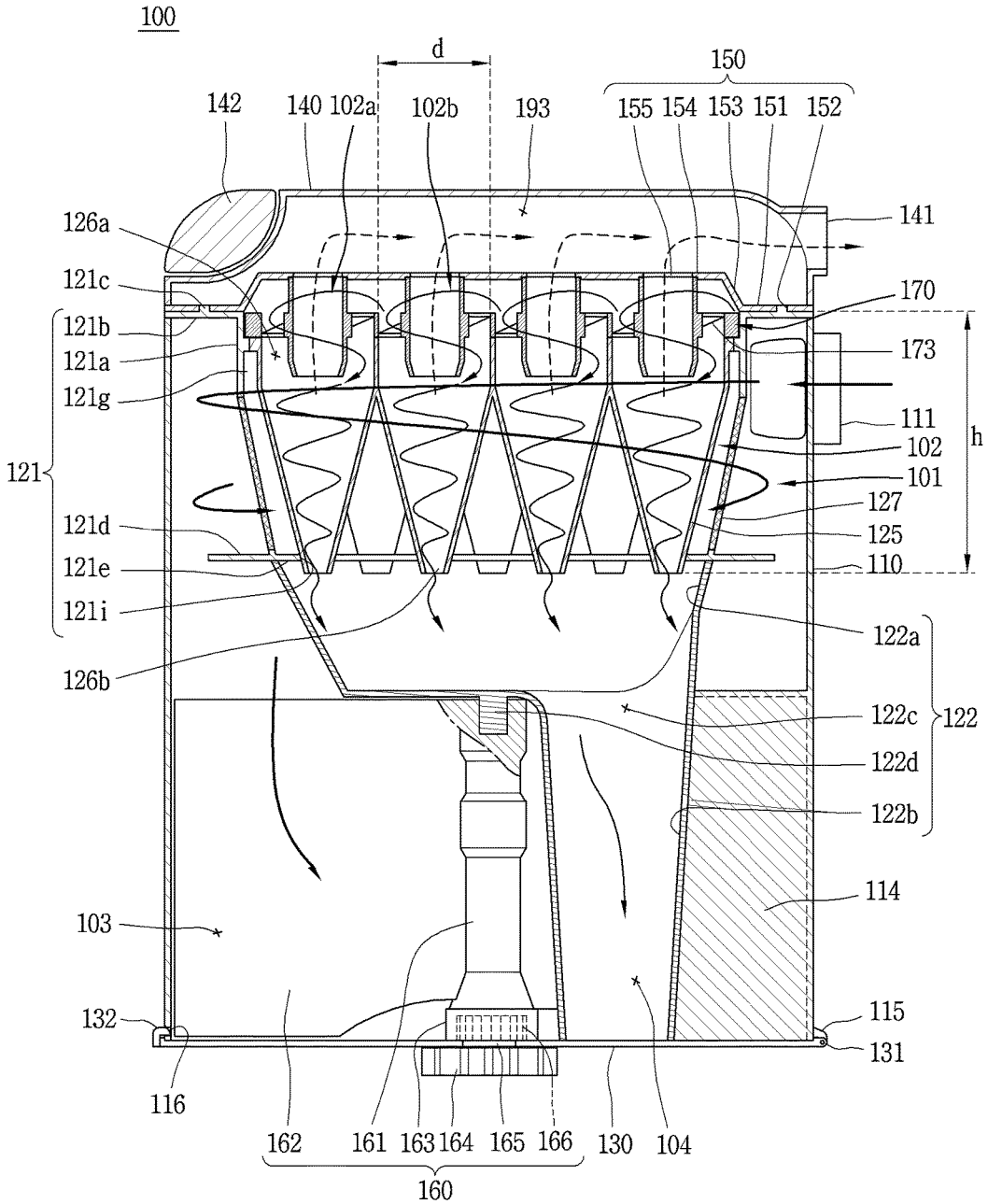
FIG. 4 is a longitudinal sectional view taken along line 'A-A' in the dust collector of FIG. 2.
Figure 5:
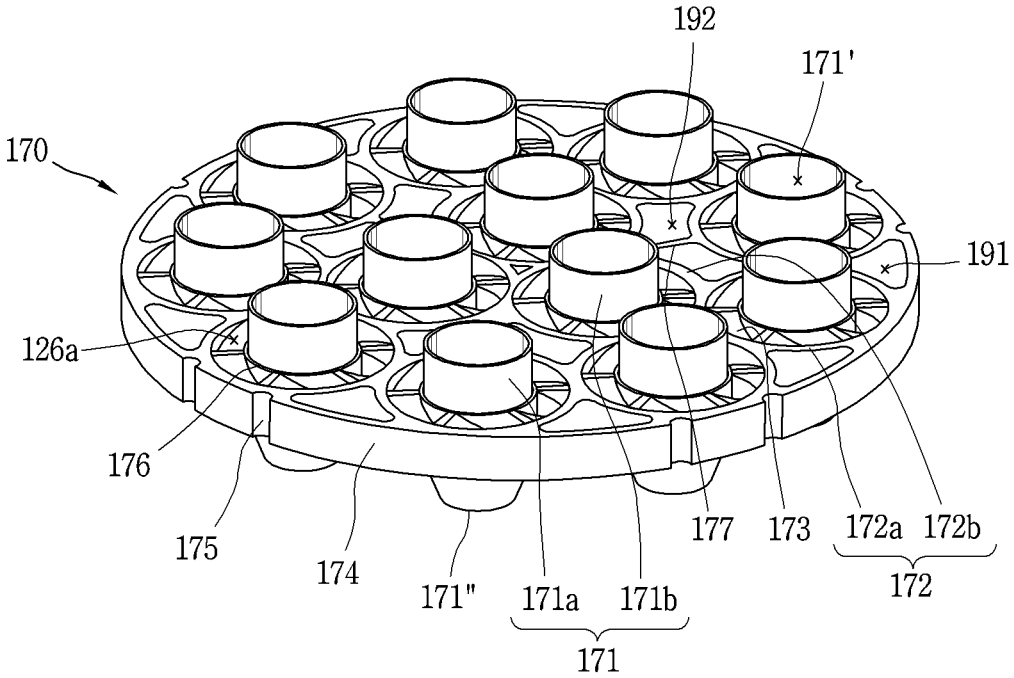
FIG. 5 is a perspective view of a fine dust separating member shown in FIGS. 3 and 4.

The fine dust separating member 170 is disposed on the casings 125, thereby forming a set of the axial cyclones 102*a*, 102*b* together with the casings 125. Certain implementations are characterized in that the set of the axial cyclones 102*a*, 102*b* is formed by the casings 125 and the single fine dust separating member 170. Hereinafter, a structure of the fine dust separating member 170 will be explained with reference to FIGS. 3 to 5. FIG. 5 is a perspective view of the fine dust separating member 170 shown in FIGS. 3 and 4.

The fine dust separating member 170 includes vortex finders 171, band portions 172, guide vanes 173, and an outer band portion 174. Since the fine dust separating member 170 is an integrated member, the vortex finders 171, the band portions 172, the guide vanes 173, and the outer band portion 174 mean the respective parts of the fine dust separating member 170. According to a design, the fine dust separating member 170 may not be provided with the outer band portion 174. One fine dust separating member 170 includes a plurality of vortex finders 171, a plurality of band portions 172, a plurality of guide vanes 173, and one outer band portion 174.

The vortex finders 171 are configured to discharge air separated from fine dust. Each of the vortex finders 171 is disposed inside each of the casings 125, and an outer circumferential surface of each vortex finder 171 is spaced from an inner circumferential surface of each casing 125. Each vortex finder 171 has a structure to form an outer wall around a hollow portion 171', and air introduced into an inlet 171" of each vortex finder 171 is discharged to the upper side through the hollow portion 171'.

An upper part and a lower part of the vortex finder 171 are formed such that a total height thereof is higher than that of the band portions 172 or the outer band portion 174. In the drawings, it can be seen that an upper end and a lower end of each vortex finder 171 protrude from the fine dust separating member 170 upward and downward, respectively. Referring to FIG. 4, the lower part of the vortex finder 171 may be formed in an inclined shape having a narrower area towards the lower side. The reason is in order to prevent discharge of fine dust to the vortex finder 171 along air.

Referring to FIG. 4, the upper part of the vortex finder 171 is formed to have a predetermined inner diameter. The upper part and the lower part of the vortex finder 171 may be distinguished from each other, based on a position where the inner diameter of the vortex finder 171 is reduced.

The vortex finders 171 may be divided into first group vortex finders 171*a* and second group vortex finders 171*b*. The first group vortex finders 171*a* may be disposed to be inserted into the first group casings 125*a*, and the second group vortex finders 171*b* may be disposed to be inserted into the second group casings 125*b*. The vortex finders 171 are provided in the same number as the axial cyclones 102*a*, 102*b*. As aforementioned, since the set of the axial cyclones 102*a*, 102*b* is formed by the casings 125 and the fine dust separating member 170, the number of the axial cyclones 102*a*, 102*b* is the same as the number of the vortex finders 171.

The band portion 172 is formed to enclose an outer circumferential surface of the vortex finder 171, at a position spaced apart from the vortex finder 171. As the band portion 172 and the vortex finder 171 are spaced apart from each other, an inlet 126*a* of each of the axial cyclones 102*a*, 102*b* is formed therebetween. Air and fine dust are introduced into the inlets 126*a* of each of the axial cyclones 102*a*, 102*b*, in an axial direction.

The band portion 172 may be referred to as another portion if necessary. For instance, the band portion 172 may be referred to as an annular portion, a ring portion, an edge portion, a circumference portion, a circle portion, a supporting portion, a connection portion, an outer peripheral portion, a cyclone interface portion, an outer wall portion, etc.

Figure 3:
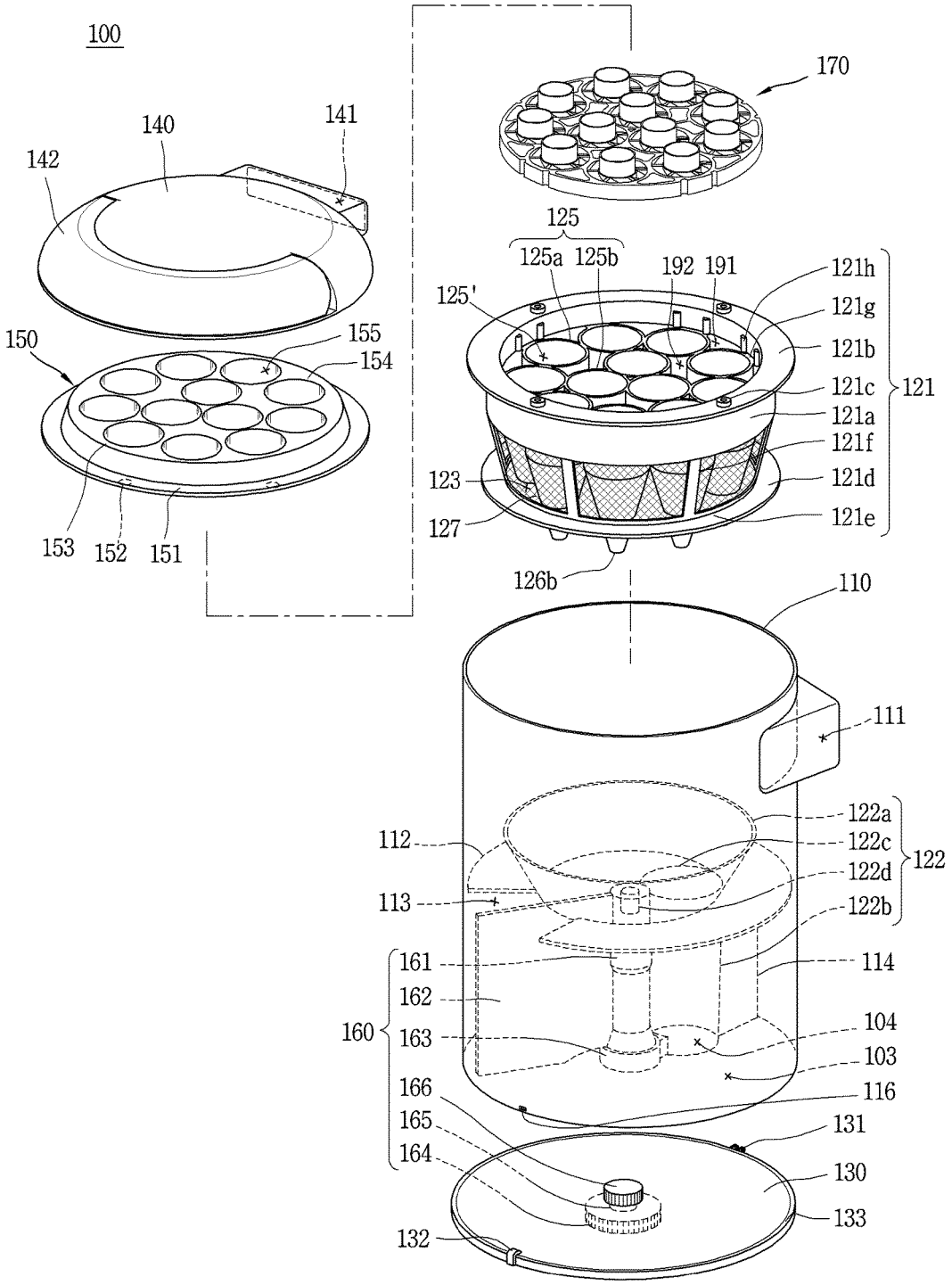
FIG. 3 is a disassembled perspective view of the dust collector shown in FIG. 2.

The band portions 172 are mounted on the casings 125, and have a shape corresponding to an upper part of the casings 125 in order to form outer walls of the axial cyclones 102*a*, 102*b*, together with the casings 125. Referring to FIG. 3, an upper part of the casing 125 is formed to have a cylindrical shape, and the band portion 172 is also formed to have a cylindrical shape which encloses the vortex finder 171. However, the upper part of the casing 125, and the band portion 172 may be formed to have a polygonal shape.

The fine dust separating member 170 and the casings 125 have a coupling position therebetween set by a position fixing groove and a position fixing protrusion, and are formed to prevent a relative rotation with respect to each other. Since the vortex finders 171 are spaced apart from the casings 125, the fine dust separating member 170 and the casings 125 may have a relative rotation with respect to each other. For a normal operation of the dust collector 100, such a relative rotation should be prevented.

The position fixing protrusion is formed to be insertable into the position fixing groove, and may be formed at one of the band portions 172 and the casings 125. The position fixing groove is formed to accommodate therein the position fixing protrusion, and may be formed at another of the band portions 172 and the casings 125. Each of the position fixing groove and the position fixing protrusion may be provided in plurality.

Once the fine dust separating member 170 is mounted on the casings 125, the casings 125 and the band portions 172 are engaged with each other to form outer walls of the axial cyclones 102*a*, 102*b*. For convenience, outer walls formed by the casings 125 may be referred to as 'lower outer walls', and outer walls formed by the band portions 172 may be referred to as 'upper outer walls'.

The band portions 172 may be divided into first group band portions 172*a* and second group band portions 172*b*. The first group band portions 172*a* may be disposed to be mounted to the first group casings 125*a*, and the second group band portions 172*b* may be disposed to be mounted to the second group casings 125*b*.

The first group band portions 172*a* may be disposed to contact the second group band portions 172*b*. Each of the band portions 172 may preferably have a cylindrical sectional surface, such that a passage 191 of air and fine dust is formed among the band portions 172 even if the band portions 172 contact each other. If the passage 191 of air and fine dust is formed among the band portions 172, an additional passage structure needs not be installed. However, each of the band portions 172 may have a polygonal sectional surface. In this case, the polygonal sectional surface should be implemented such that a passage of air and fine dust may be formed.

The band portions 172 are provided in the same number as the axial cyclones 102*a*, 102*b*. As aforementioned, since the set of the axial cyclones 102*a*, 102*b* is formed by the casings 125 and the fine dust separating member 170, the number of the axial cyclones 102*a*, 102*b* is the same as the number of the band portions 172.

Guide vanes 173 are disposed between the vortex finders 171 and the band portions 172, and are connected to the vortex finders 171 and the band portions 172. One side of the guide vanes 173 is connected to an outer circumferential surface of the vortex finders 171, and another side thereof is connected to an inner circumferential surface of the band portions 172. The plurality of guide vanes 173 may be provided at each of the axial cyclones 102*a*, 102*b*, and extend in a spiral direction so as to generate a vortex. One side of the guide vanes 173 may be connected to an outer circumferential surface of the vortex finders 171 in a spiral direction, and another side of the guide vanes 173 may be connected to an inner circumferential surface of the band portions 172 in a spiral direction. As the guide vanes 173 extend in a spiral direction, air and fine dust introduced into the inlets 126*a* of the axial cyclones 102*a*, 102*b* form a vortex. Unlike a tangential introduction type cyclone, the axial cyclones 102*a*, 102*b* generate a vortex by the guide vanes 173, a passage structure for introducing air in a tangential direction is not required.

Each of the guide vanes 173 may extend from a lower end of the band portion 172 to an upper end of the band portion 172, in a spiral direction. The extension from the lower end to the upper end means that the guide vanes 173 have the same height as the band portions 172. As the guide vanes 173 have the same height as the band portions 172, interference with other components and damage may be reduced.

An outer band portion 174 is formed to enclose the band portions 172, thereby forming an edge of the fine dust separating member 170. The outer band portion 174 encloses the band portions 172. As aforementioned, the band portions 172 may be divided into the first group band portions 172*a* and the second group band portions 172*b*. The outer band portion 174 is formed to enclose the first group band portions 172*a*. The outer band portion 174 may be connected to the first group band portions 172*a*. The outer band portion 174 may have the same height as the band portions 172 and the guide vanes 173. As the outer band portion 174 has the same height as the band portions 172 and the guide vanes 173, interference with other components and damage may be reduced.

The outer band portion 174 is mounted in the inner cases 121, 122. The first member 121 of the inner cases 121, 122 is formed to enclose the outer band portion 174, and is provided with a stair-stepped portion 121*g* formed along an inner circumferential surface of the first member in order to support the outer band portion 174. The stair-stepped portion 121*g* has a shape corresponding to the outer band portion 174. For instance, the stair-stepped portion 121*g* may be formed to have a cylindrical shape in correspondence to the cylindrical outer band portion 174. The outer band portion 174 may be mounted to the stair-stepped portion 121*g* in the first member 121.

The fine dust separating member 170 and the inner cases 121, 122 have a coupling position therebetween set by a position fixing groove 175 and a position fixing protrusion 121*h*, and are formed to prevent a relative rotation with respect to each other. Since the vortex finders 171 are separated from the casings 125, the fine dust separating member 170 and the casings 125 may have a relative rotation with respect to each other. For a normal operation of the dust collector 100, such a relative rotation should be prevented.

The position fixing protrusion 121*h* is formed to be insertable into the position fixing groove 175, and may be formed at one of the outer band portion 174 and the inner cases 121, 122. The position fixing groove 175 is formed to accommodate therein the position fixing protrusion 121*h*, and may be formed at another of the outer band portion 174 and the inner case 121. If the position fixing groove 175 or the position fixing protrusion 121*h* is formed at the inner case 121, the position fixing groove 175 or the position fixing protrusion 121*h* may be formed on an inner side surface or the stair-stepped portion 121*g* of the inner cases 121, 122. FIG. 3 shows a configuration that the position fixing protrusion 121*h* is formed on an inner side surface of the inner cases 121, 122. Each of the position fixing groove 175 and the position fixing protrusion 121*h* may be provided in plurality.

It is also possible that the outer band portion 174 is mounted on an upper end of the first group casings 125*a*. For instance, a protrusion protruded towards an inner circumferential surface of the first member 121 may be formed at an upper end of the casings 125, and the outer band portion 174 may be mounted to the protrusion.

A passage 192 of air and fine dust is formed between the outer band portion 174 and the first group band portions 172*a*. Since a radius of the outer band portion 174 is larger than that of the first group band portions 172*a*, the passage 192 of air and fine dust is formed between the outer band portion 174 and the first group band portions 172*a*. If the passage 192 of air and fine dust is formed between the outer band portion 174 and the first group band portions 172*a*, an additional passage structure needs not be installed.

The outer band portion 174 forms an outer wall of the secondary cyclone unit 102, together with the casings 125. The outer wall of the secondary cyclone unit 102 may be divided into a lower part and an upper part, based on a boundary between the outer band portion 174 the casings 125. The casings 125 form a lower outer wall of the secondary cyclone unit 102, and the outer band portion 174 forms an upper outer wall of the secondary cyclone unit 102.

Outer walls of the axial cyclones 102*a*, 102*b* are formed by the casings 125 and the band portions 172, and the outer wall of the secondary cyclone unit 102 is formed by the casings 125 and the outer band portion 174. The outer walls of the axial cyclones 102*a*, 102*b* are distinguished from the outer wall of the secondary cyclone unit 102. Further, as aforementioned, the boundary between the primary cyclone unit 101 and the secondary cyclone unit 102 is formed by the inner cases 121, 122.

The vortex finders 171 and the band portions 172 are connected to each other by the guide vanes 173, the band portions 172 are connected to each other, and the outer band portion 174 is connected to the second band portions. Accordingly, the fine dust separating member 170 may be implemented as a single integrated member.

Once the fine dust separating member 170 is mounted on the casings 125, a set of the axial cyclones 102*a*, 102*b* is formed. The secondary cyclone unit 102 is formed by the set of the axial cyclones 102*a*, 102*b*. The set of the axial cyclones 102*a*, 102*b* may include first group axial cyclones 102*a*, and second group axial cyclones 102*b*. The first group casings 125*a*, the first group vortex finders 171*a*, and the first group band portions 172*a* form the first group axial cyclones 102*a*. Likewise, the second group casings 125*b*, the second group vortex finders 171*b*, and the second group band portions 172*b* form the second group axial cyclones 102*b*.

The first group axial cyclones 102*a* are arranged along a circumference of a first circle (circle 1' in FIG. 9) so as to contact an inner circumferential surface of the inner cases 121, 122. The inner cases 121, 122 to which the first group axial cyclones 102*a* contact mean the first member 121. And the first circle ('i') indicates a virtual circle larger than a second circle (circle 'ii' in FIG. 9) to be explained later.

The configuration that the first group axial cyclones 102*a* are arranged along the circumference of a first circle ('i') means that the circumference of the first circle ('i') passes through the first group axial cyclones 102*a*. This should be distinguished from a configuration that a center portion of the first group axial cyclones 102*a* is arranged along the circumference of a first circle ('i'). The first group axial cyclones 102*a* may be arranged to have the same distance from the center of the secondary cyclone unit 102, or may be arranged to have different distances from the center of the secondary cyclone unit 102.

Referring to FIGS. 2 to 5, the first group axial cyclones 102*a* are formed of 9 axial cyclones. And the first group axial cyclones 102*a* are arranged to enclose the second group axial cyclones 102*b* formed of 3 axial cyclones. From the drawings, it can be seen that the first group axial cyclones 102*a* are arranged to contact an inner circumferential surface of the first member 121. The contact means that an outermost region of the first group axial cyclones 102*a* is connected to the inner cases 121, 122.

The first group axial cyclones 102*a* are partially spaced apart from the inner cases 121, 122, thereby forming a plurality of first passage 191 therebetween. If the axial cyclones 102*a*, 102*b* have a circular sectional surface, the first group axial cyclones 102*a* partially contact an inner circumferential surface of the inner cases 121, 122, and are partially spaced apart from the inner circumferential surface of the inner cases 121, 122. For instance, referring to FIG. 3, the casings 125 are arranged such that upper regions thereof contact an inner circumferential surface of the first member 121. Since the casings 125 have a circular sectional surface, regions except for the upper regions contacting the inner circumferential surface of the first member 121 are spaced from the inner circumferential surface of the first member 121.

Since the first group axial cyclones 102*a* are partially spaced apart from the inner circumferential surface of the first member 121, passages of air and fine dust are formed between the first group axial cyclones 102*a* and the inner circumferential surface of the first member 121. The passages may be referred to as 'first passages' 191 that are distinguished from second passages 192 to be explained later. Referring to FIG. 3, since the number of the first group axial cyclones 102*a* is nine, nine of the first passages 191 may be formed in first member 121. The first group axial cyclones 102*a* may be arranged to contact each other, but certain implementations are not limited to this configuration. For instance, first group axial cyclones 102*a* may be arranged to contact each other in groups of 3 axial cyclones.

The second group axial cyclones 102*b* may be arranged to contact each other along a circumference of the second circle ('ii'). The second circle ('ii') is concentric with the first circle (i), and is smaller than the first circle (i). Accordingly, the second group axial cyclones 102*b* are arranged so as to be enclosed by the first group axial cyclones 102*a*.

The configuration that the second group axial cyclones 102*b* are arranged along the circumference of the second circle ('ii') means that the circumference of the second circle ('ii') passes through the second group axial cyclones 102*b*. The second group axial cyclones 102*b* may be arranged to have the same distance from the center of the secondary cyclone unit 102, or may be arranged to have different distances from the center of the secondary cyclone unit 102. Referring to FIGS. 3 and 5, the second group axial cyclones 102*b* are arranged to have an angle of 120° therebetween on the basis of the center of the secondary cyclone unit 102.

The second group axial cyclones 102*b* are arranged to contact each other. The contact means that outermost regions of the second group axial cyclones 102*b* are connected to each other. Referring to FIG. 3, the second group axial cyclones 102*b* are arranged to contact each other in three in number.

The second group axial cyclones 102*b* partially contact the first group axial cyclones 102*a*, and are partially spaced apart from the first group axial cyclones 102*a*, thereby forming passage 192 of air and fine dust therebetween. If the axial cyclones 102*a*, 102*b* have a circular sectional surface, the second group axial cyclones 102*b* partially contact the first group axial cyclones 102*a*, and are partially spaced apart from the first group axial cyclones 102*a*. For instance, referring to FIG. 3, since the second group axial cyclones 102*b* have a circular sectional surface, other regions of the second group axial cyclones 102*b*, except for the contact regions with the first group axial cyclones 102*a*, are spaced apart from the first group axial cyclones 102*a*.

As the second group axial cyclones 102*b* partially contact the first group axial cyclones 102*a* and are partially spaced apart from the first group axial cyclones 102*a*, passage 192 of air and fine dust are formed between the first group axial cyclones 102*a* and the second group axial cyclones 102*b*. The passages may be referred to as 'second passages' 192 to be distinguished from the first passages 191. Referring to FIG. 3, since the number of the second group axial cyclones 102*b* is 3, the second passages 192 are formed in 3. In this case, division of the second passages 192 by bridges 177 has not been considered.

The bridges 177 are connected to the first group axial cyclones 102*a* and the second group axial cyclones 102*b* by crossing the second passages 192. The bridge 177 is configured to divide one second passage 192 into two regions. The bridge 177 may be formed between the casings 125, or between the band portions 172. One end of the bridge 177 may be connected to one of the first group axial cyclones 102*a*, and another end of the bridge 177 may be connected to two of the second group axial cyclones 102*b*.

The bridge 177 may be formed at each of the second passages 192. For instance, referring to FIG. 5, the bridge 177 is formed at each of the 3 second passages 192, and divides each of the 3 second passages 192 into two regions. The reason why the bridges 177 are formed is in order to reinforce intensity of the secondary cyclone unit 102, and to uniformly distribute a vortex.

In order to form the second passages 192, the first group axial cyclones 102*a* and the second group axial cyclones 102*b* are partially spaced apart from each other. Once the first group axial cyclones 102*a* and the second group axial cyclones 102*b* are connected to each other by the bridges 177, intensity of the secondary cyclone unit 102 may be reinforced.

If each of the second passages 192 has an excessive large sectional area, a vortex of air and fine dust introduced into the secondary cyclone unit 102 from the primary cyclone unit 102 may be concentrated to one region inside the single second passage 192. The reason is because air and fine dust form a vortex motion. However, if the single bridge 177 is divided into two regions, concentration of a vortex to one region inside the single second passage 192 may be prevented, and a vortex may be uniformly introduced into each of the first group axial cyclones 102*a* and the second group axial cyclones 102*b*.

The axial cyclones 102*a*, 102*b* have characteristics that an inflow is generated in an axial direction and a vortex thereof is formed by the guide vanes 173. Accordingly, the axial cyclones 102*a*, 102*b* preferably have a structure that an inflow is generated uniformly in all directions. The reason is because a flow area of the axial cyclones 102*a*, 102*b* is not utilized and a flow loss occurs, if an inflow is not uniformly formed.

In certain implementations, a sum (a) of sectional areas of the first passages 191 is designed not to have a large difference from a sum (b) of sectional areas of the second passages 192. This will be explained later in more detail.

Performance of each of the axial cyclones 102*a*, 102*b* is variable according to a ratio of a height (h) and a diameter (d) of the axial cyclones 102*a*, 102*b*. The height (h) of the axial cyclones 102*a*, 102*b* is defined as a distance from a lower end of the casings 125 to an upper end of the guide vanes 173. The height (h) is the same as a height difference between a flow starting point and a flow ending point inside the axial cyclones 102*a*, 102*b*. The diameter (d) of the axial cyclones 102*a*, 102*b* is defined as a maximum diameter (d) of the casings 125. Since a sectional surface of the casings 125 is constant but is gradually narrowed from an upper end to a lower end of the casings 125, the diameter (d) of the axial cyclones 102*a*, 102*b* should be defined as a diameter before the sectional surface of the casings 125 is reduced.

Further, since the maximum diameter of the casings 125 is the same as a diameter of the band portions 172, the diameter (d) of the axial cyclones 102*a*, 102*b* may be defined as the diameter of the band portions 172. Since the band portions 172 have a constant sectional area, the concept of a maximum or minimum diameter of the band portions 172 needs not be applied.

In certain implementations, a ratio (h/d) of the height (h) and the diameter (d) of the axial cyclones 102*a*, 102*b* is designed to be within a range of 3~5. For optimum performance of the axial cyclones 102*a*, 102*b*, the ratio (h/d) is preferably about 4. If the ratio (h/d) is smaller than 3, fine dust may not be sufficiently separated from air. On the other hand, if the ratio (h/d) is larger than 5, fine dust may not be discharged downwardly.

Under an assumption that the axial cyclones 102*a*, 102*b* have a constant height, if the number of the axial cyclones 102*a*, 102*b* is too small, the diameter (d) is increased and the ratio (h/d) is decreased. Accordingly, fine dust may not be sufficiently separated from air. In this case, the number of the axial cyclones 102*a*, 102*b* may be increased. If the number of the axial cyclones 102*a*, 102*b* is increased, the diameter (d) is decreased so that the ratio (h/d) may be within the range of 3~5.

The first group axial cyclones 102*a* and the second group axial cyclones 102*b* are disposed in upper and lower directions in the drawings, and may be disposed in parallel. Accordingly, the axial cyclones 102*a*, 102*b* may be efficiently arranged in the primary cyclone unit 101. Especially, since the axial cyclones 102*a*, 102*b* do not require an additional guide passage for introducing air in a tangential direction, a larger number of axial cyclones 102*a*, 102*b* may be arranged in the primary cyclone unit 101. Since the number of the axial cyclones 102*a*, 102*b* accommodated in the primary cyclone unit 101 is not smaller than the conventional one, lowering of cleaning performance may be prevented.

Further, unlike a vertical cyclone where a vortex of high speed is generated at one side by a guide passage, the axial cyclones 102*a*, 102*b* generate a relatively uniform vortex over an entire region of the inlets 126*a*. Since a vortex of high speed is not partially generated from the axial cyclones 102*a*, 102*b*, a flow loss may be reduced.

Unlike a configuration that the secondary cyclone unit 102 is disposed above the primary cyclone unit 101, the secondary cyclone unit 102 of certain implementations may be accommodated in the primary cyclone unit. This may reduce an entire height of the dust collector 100.

The second dust collecting portion 104 is configured to collect fine dust separated from air by the secondary cyclone unit 102. The second dust collecting portion 104 means a space defined by the dust collecting portion boundary 122*b* and the lower cover 130.

The inner cases 121, 122 may include the first member 121 and the second member 122. And the dust collecting portion boundary 122*b* of the second member 122 is formed in a hollow cylindrical shape, and is adhered to the lower cover 130. However, the dust collecting portion boundary 122*b* may be formed in a hollow polygonal shape. The second member 122 includes the accommodation portion 122*a*, and the accommodation portion 122*a* may form an inclination when the dust collector 100 is coupled to the cleaner body 11. Fine dust discharged from the fine dust outlet 126*b* may be collected at the second dust collecting portion 104 by sliding due to the inclination.

The dust collecting portion boundary 122*b* forms a boundary between the first dust collecting portion 103 and the second dust collecting portion 104. This may prevent dust collected at the first dust collecting portion 103, from being mixed with fine dust collected at the second dust collecting portion 104. The second dust collecting portion 104 is formed inside the first dust collecting portion 103, and the first dust collecting portion 103 corresponds to a region except for the second dust collecting portion 104.

The dust collecting portion boundary 122*b* forms a side wall of the second dust collecting portion 104, and the lower cover 130 forms a bottom of the second dust collecting portion 104. A hole 122*c* is formed at a boundary between the accommodation portion 122*a* of the second member 122 and the second dust collecting portion 104. The hole 122*c* corresponds to a fine dust inlet of the second dust collecting portion 104. The dust collecting portion boundary 122*b* may be formed to have an inner diameter narrowed toward the lower side. With such a structure, dropping of fine dust may be induced, and thus efficient dust collection may be performed.

The structure of the dust collecting portion boundary 122*b* and the lower cover 130 will be replaced by the aforementioned one. Like the first dust collecting portion 103, the second dust collecting portion 104 is formed to be open toward the lower part of the dust collector 100. And the configuration to simultaneously open the first and second dust collecting portions 103, 104 by rotation of the lower cover 130 will be replaced by the aforementioned one.

The passage of the dust collector 100 may be explained with flow of air. The inlet 111 of the dust collector 100 is formed at the outer case 110, and air is introduced into the dust collector 100 from the inlet side passage 14 inside the vacuum cleaner through the inlet 111.

Passages of the primary cyclone unit 101 are formed between an inner circumferential surface of the outer case 110 and an outer circumferential surface of the inner cases 121, 122. Once dust is separated from air by the primary cyclone unit 101, the air and fine dust are introduced into a passage between the primary cyclone unit 101 and the secondary cyclone unit 102. The first and second dust collecting portion 103 is communicated with the primary cyclone unit 101.

The passages between the primary cyclone unit 101 and the secondary cyclone unit 102 are formed between the first group axial cyclones 102*a* and the inner cases 121, 122, and between the first group axial cyclones 102*a* and the second group axial cyclones 102*b*. As aforementioned, passages between the first group axial cyclones 102*a* and the inner cases 121, 122 are referred to as the first passages 191, and passages between the first group axial cyclones 102*a* and the second group axial cyclones 102*b* are referred to as the second passages 192. Air and fine dust pass through the mesh filter 127, and are introduced into the secondary cyclone unit 102 through the passage between the primary cyclone unit 101 and the secondary cyclone unit 102.

The inlets 126*a* of the secondary cyclone unit 102 are formed between the vortex finders 171 and the band portions 172 of the axial cyclones 102*a*, 102*b*. Each of the axial cyclones 102*a*, 102*b* is provided with the vortex finder 171 for discharging air, and the fine dust outlet 126*b* for discharging fine dust. The second dust collecting portions 104 is communicated with the fine dust outlet 126*b*.

The cover member 150 is disposed above the secondary cyclone unit 102. An outer cover 151 of the cover member 150 has a shape corresponding to the upper boundary portion 121*b* of the inner cases 121, 122, and is disposed to cover the upper boundary portion 121*b*. As the protrusion 121*c* of the upper boundary portion 121*b* is inserted into the groove 152 of the outer cover 151, the cover member 150 may be mounted to the upper boundary portion 121*b*. The protrusion 121*c* and the groove 152 serve to set a position of the first member 121 and the cover member 150, and communication holes 155 of the cover member 150 are arranged to face the vortex finders 171 at the position set by the protrusion 121*c* and the groove 152. The positions of the protrusion 121*c* and the groove 152 may be switched from each other.

The communication holes 155 are formed at an inner cover 154 of the cover member 150. And an inclined portion 153, formed to be inclined, connects the outer cover 151 and the inner cover 154 with each other. The inner cover 154 may be spaced apart from the band portions 172 by the inclined portion 153. This may allow the inlet 126*a* of the axial cyclones 102*a*, 102*b* to be sufficiently obtained.

A passage 193 between the secondary cyclone unit 102 and the outlet 141 is formed between the cover member 150 and the upper cover. And air discharged from the secondary cyclone unit 102 is discharged to the outlet 141 along the passage 193.

Air and foreign materials are introduced into the inlet 111 of the dust collector 100, through the suction unit 13 or 23 (refer to FIGS. 1A and 1B), by a suction force generated from the suction motor of the vacuum cleaner 10. The air introduced into the inlet 111 of the dust collector 100 is sequentially filtered at the primary cyclone unit 101 and the secondary cyclone unit 102, while moving along the passage. Then, the air is discharged out through the outlet 141. Dust and fine dust separated from the air are collected at the dust collector 100.

Processes of separating dust from air by the primary cyclone unit 101 will be first explained in more detail. Air and foreign materials are introduced into a ring-shaped space between the outer case 110 and the inner cases 121, 122, through the inlet 111 of the dust collector 100, and performs a vortex motion at the ring-shaped space. During these processes, dust relatively heavier than air performs a vortex motion at a space between the outer case 110 and the inner cases 121, 122, by a centrifugal force. Then, the dust gradually moves downward to be collected at the first dust collecting portion 103. The pressing unit 160 is continuously operated to compress the dust collected at the first dust collecting portion 103.

Since air and fine dust are lighter than dust, they are introduced into the inner cases 121, 122 through the mesh filter 127 by a suction force. Then, the air and the fine dust pass through the first passage 191 and the second passage 192, thereby being introduced into the axial cyclones 102*a*, 102*b* of the secondary cyclone unit 102.

Dust and fine dust perform a vortex motion in the axial cyclones 102*a*, 102*b*, along the guide vanes 173. Fine dust heavier than air performs a vortex motion between the vortex finders 171 and the band portions 172, and gradually moves downward. Then, the fine dust is discharged through the fine dust outlet 126*b*, and is collected at the second dust collecting portion 104. Air lighter than fine dust is discharged to the passage 193 between the cover member 150 and the upper cover 140 through the inside of the vortex finders 171, and is discharged out of the dust collector 100 through the outlet 141.

The second embodiment is different from the first embodiment in that an auxiliary member 280 is further provided. Accordingly, only a differentiated configuration will be explained with the auxiliary member 280, and explanations about other components will be replaced by those of the first embodiment. A secondary cyclone unit 202 includes the auxiliary member 280, and a set of axial cyclones is formed by casings 225, a fine dust separating member 270, and the auxiliary member 280 mounted on the fine dust separating member 270.

A thickness of the fine dust separating member 270 and the auxiliary member 280 influences on separation performance and efficiency of the dust collector 200. The auxiliary member 280 serves to assist the fine dust separating member 270, and has lowered efficiency due to a pressure loss when the auxiliary member 280 is formed to be excessively thick. Thus, the auxiliary member 280 is preferably formed to be thinner than the fine dust separating member 270. On the other hand, the fine dust separating member 270 serves to separate fine dust from air, and is preferably formed to be thicker than the auxiliary member 280.

The auxiliary member 280 includes cover portions 281, auxiliary band portions 282, auxiliary guide vanes 283, and an auxiliary outer band portion 284. Since the auxiliary member 280 is a single integrated member, the cover portions 281, the auxiliary band portions 282, the auxiliary guide vanes 283 and the auxiliary outer band portion 284 mean the respective parts of the auxiliary member 280. According to a design, the auxiliary member 280 may not be provided with the auxiliary outer band portion 284.

The cover portions 281 may be provided in the same number as vortex finders 271, and the cover portions 281 are formed to enclose the vortex finders 271 of the fine dust separating member 270. The cover portions 281 may have a shape corresponding to the vortex finders 271, and may be formed in a hollow cylindrical shape, for example.

The fine dust separating member 270 may be provided with supporting portions 276 protruded along an outer circumferential surface of the vortex finders 271, and the supporting portions 276 form stair-stepped portions along the outer circumferential surface of the vortex finders 271. The cover portions 281 have a shape corresponding to the supporting portions 276, so as to be mounted to the supporting portions 276. For instance, if the supporting portions 276 are formed in a circular shape along the outer circumferential surface of the vortex finders 271, the cover portions 281 may be also formed in a circular shape.

Theoretically, the cover portion 281 may have the same diameter as the supporting portion 276. And an outer diameter of the vortex finder 271 may be the same as an inner diameter of the cover portion 281. With such a configuration, the cover portions 281 may be coupled to the vortex finders 271 with enclosing the outer circumferential surface of the vortex finders 271, and may be mounted to the supporting portions 276.

As the cover portions 281 enclose the vortex finders 271, a position of the auxiliary member 280 is fixed. Thus, the auxiliary member 280 and the fine dust separating member 270 do not require an additional position fixing structure, and are not relatively rotated with respect to each other even if an additional position fixing structure is not provided. Accordingly, the auxiliary member 280 and the fine dust separating member 270 are different from each other.

Figure 7:
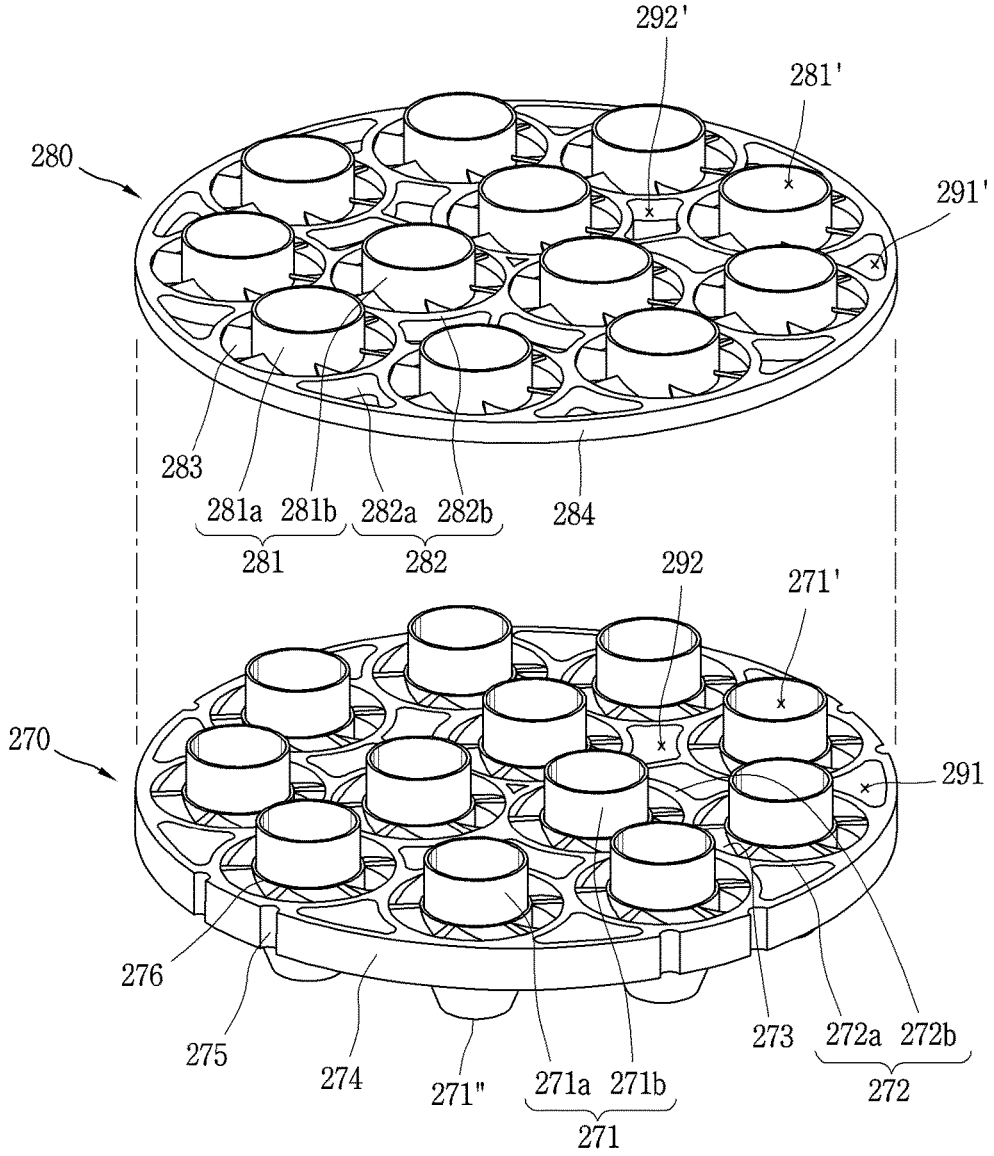
FIG. 7 is a perspective view of a fine dust separating member and an auxiliary member shown in FIG. 6.

An upper part of the cover portion 281 may be higher than the auxiliary band portion 282 or the auxiliary outer band portion 284, like the vortex finder 271 of the fine dust separating member 270. However, unlike the vortex finder 271, a lower part of the cover portion 281 may not be protruded from the auxiliary band portion 282 or the auxiliary outer band portion 284. Referring to FIG. 7, an upper end of the cover portion 281 is upward protruded from the auxiliary member 280, unlike a lower end of the cover portion 281. With such a configuration, the cover portions 281 may have a constant inner diameter.

The cover portions 281 may be divided into first group cover portions 281*a* and second group cover portions 281*b*. The first group cover portions 281*a* are coupled to the first group vortex finders 271*a*, and the second group cover portions 281*b* are coupled to the second group vortex finders 271*b*.

The auxiliary band portions 282 are formed to enclose an outer circumferential surface of the cover portions 281, at a position spaced apart from the cover portions 281. As the auxiliary band portions 282 and the cover portions 281 are spaced apart from each other, inlets 226*a* of axial cyclones are formed therebetween. Air and fine dust are introduced into the inlets 226*a* of the axial cyclones, in an axial direction.

The auxiliary band portion 282 may be referred to as another portion if necessary. For instance, the auxiliary band portion 282 may be referred to as an auxiliary annular portion, an auxiliary ring portion, an auxiliary edge portion, an auxiliary circumference portion, an auxiliary circle portion, an auxiliary supporting portion, an auxiliary connection portion, an auxiliary outer peripheral portion, an auxiliary cyclone interface portion, an auxiliary outer wall portion, etc.

The auxiliary band portions 282 are mounted to the band portions 272, and have a shape corresponding to the band portions 272 in order to form outer walls of the axial cyclones 102*a*, 102*b* together with the casings 225 and the band portions 272. Referring to FIG. 7, the band portions 272 are formed in a circular shape, and the auxiliary band portions 282 are also formed in a circular shape. However, the band portions 272 and the auxiliary band portions 282 may be formed in a polygonal shape.

If the auxiliary member 280 is mounted on the fine dust separating member 270 and the fine dust separating member 270 is mounted on the casings 225, the casings 225 and the band portions 272 are engaged with each other to outer walls of the axial cyclones. For convenience, outer walls formed by the casings 225 may be referred to as 'lower outer walls', outer walls formed by the band portions 272 may be referred to as 'middle outer walls', and outer walls formed by the auxiliary band portions 282 may be referred to as 'upper outer walls'.

The auxiliary band portions 282 may be divided into first group auxiliary band portions 282*a* and second group auxiliary band portions 282*b*. The first group auxiliary band portions 282*a* are mounted to the first group band portions 272*a*, and the second group auxiliary band portions 282*b* are mounted to the second group band portions 272*b*.

The first group auxiliary band portions 282*a* and the second group auxiliary band portions 282*b* may be connected to each other. As shown, each of the auxiliary band portions 282 preferably has a cylindrical sectional surface, such that a passage 292' of air and fine dust is formed among the auxiliary band portions 282 even if the auxiliary band portions 282 contact each other. If the passage 292' of air and fine dust is formed among the auxiliary band portions 282, an additional passage structure needs not be installed. However, each of the auxiliary band portions 282 may have a polygonal sectional surface. In this case, the polygonal sectional surface should be implemented such that the passage 292' of air and fine dust may be formed.

The auxiliary band portions 282 are provided in the same number as the axial cyclones. As aforementioned, since the set of the axial cyclones is formed by the casings 225, the fine dust separating member 270 and the auxiliary member 280, the number of the axial cyclones is the same as the number of the auxiliary band portions 282.

The auxiliary guide vanes 283 are disposed between the cover portions 281 and the auxiliary band portions 282, and are connected to the cover portions 281 and the auxiliary band portions 282. One side of the auxiliary guide vanes 283 is connected to an outer circumferential surface of the cover portions 281, and another side thereof is connected to an inner circumferential surface of the auxiliary band portions 282.

The plurality of auxiliary guide vanes 283 may be provided at each of the axial cyclones 102*a*, 102*b*, and extend in a spiral direction so as to generate a vortex. One side of the auxiliary guide vanes 283 may be connected to an outer circumferential surface of the cover portions 281 in a spiral direction, and another side of the auxiliary guide vanes 283 may be connected to an inner circumferential surface of the auxiliary band portions 282 in a spiral direction.

Each of the auxiliary guide vanes 283 may extend from a lower end of the auxiliary band portion 282 to an upper end of the auxiliary band portion 282, in a spiral direction. The extension from the lower end to the upper end means that the auxiliary guide vanes 283 have the same height as the auxiliary band portions 282. As the auxiliary guide vanes 283 have the same height as the auxiliary band portions 282, interference with other components and damage may be reduced.

The auxiliary outer band portion 284 is formed to enclose the auxiliary band portions 282, thereby forming an edge of the auxiliary member 280. The auxiliary outer band portion 284 encloses the auxiliary band portions 282. As aforementioned, the auxiliary band portions 282 are divided into the first group auxiliary band portions 282*a* and the second group auxiliary band portions 282*b*. And the auxiliary outer band portion 284 is formed to enclose the first group auxiliary band portions 282*a*. The auxiliary outer band portion 284 may be connected to the first group auxiliary band portions 282*a*.

The auxiliary outer band portion 284 may have the same height as the auxiliary band portions 282 and the auxiliary guide vanes 283. As the auxiliary outer band portion 284 has the same height as the auxiliary band portions 282 and the auxiliary guide vanes 283, interference with other components and damage may be reduced.

The auxiliary outer band portion 284 may be formed to be mounted to an outer band portion 274 of the fine dust separating member 270. The auxiliary outer band portion 284 may have the same shape as the outer band portion 274. For instance, as shown, the auxiliary outer band portion 284 may have a circular shape corresponding to the circular outer band portion 274.

A passage 291' of air and fine dust is formed between the auxiliary outer band portion 284 and the first group auxiliary band portions 282*a*. Since a radius of the auxiliary outer band portion 284 is larger than that of the first group auxiliary band portions 282*a*, the passage 291' of air and fine dust is formed between the auxiliary outer band portion 284 and the first group auxiliary band portions 282*a*. If the passage 291' of air and fine dust is formed between the auxiliary outer band portion 284 and the first group auxiliary band portions 282*a*, an additional passage structure needs not be installed.

The auxiliary outer band portion 284 forms an outer wall of the secondary cyclone unit 202, together with the outer band portion 274 and the casings 225. The outer wall of the secondary cyclone unit 202 may be divided into a lower part, a middle part and an upper part, based on the outer band portion 274. The casings 225 form a lower outer wall of the secondary cyclone unit 202, the outer band portion 274 forms a middle outer wall of the secondary cyclone unit 202, and the auxiliary outer band portion 284 forms an upper outer wall of the secondary cyclone unit 202.

Outer walls of the axial cyclones 102*a*, 102*b* are formed by the casings 225, the band portions 272, and the auxiliary band portions 282. And the outer wall of the secondary cyclone unit 202 is formed by the casings 225, the outer band portion 274, and the auxiliary outer band portion 284. The outer walls of the axial cyclones are distinguished from the outer wall of the secondary cyclone unit 202. Further, as aforementioned, the boundary between the primary cyclone unit and the secondary cyclone unit is formed by the inner cases 221, 222.

The cover portions 281 and the auxiliary band portions 282 are connected to each other by the auxiliary guide vanes 283, the auxiliary band portions 282 are connected to each other, and the auxiliary outer band portion 284 is connected to the first group auxiliary band portions 282*a*. Accordingly, the auxiliary member 280 may be implemented as a single integrated member.

If the auxiliary member 280 is mounted on the fine dust separating member 270 and the fine dust separating member 270 is mounted on the casings 225, a set of axial cyclones is formed. The secondary cyclone unit is formed by the set of the axial cyclones. Like the cover portions 281 or the auxiliary band portions 282, the axial cyclones may be divided into first group axial cyclones 202*a* (refer to FIG. 9) and second group axial cyclones 202*b* (refer to FIG. 9). The second group axial cyclones 202*b* may be arranged so as to be enclosed by the first group axial cyclones 202*a*.

Figure 6:
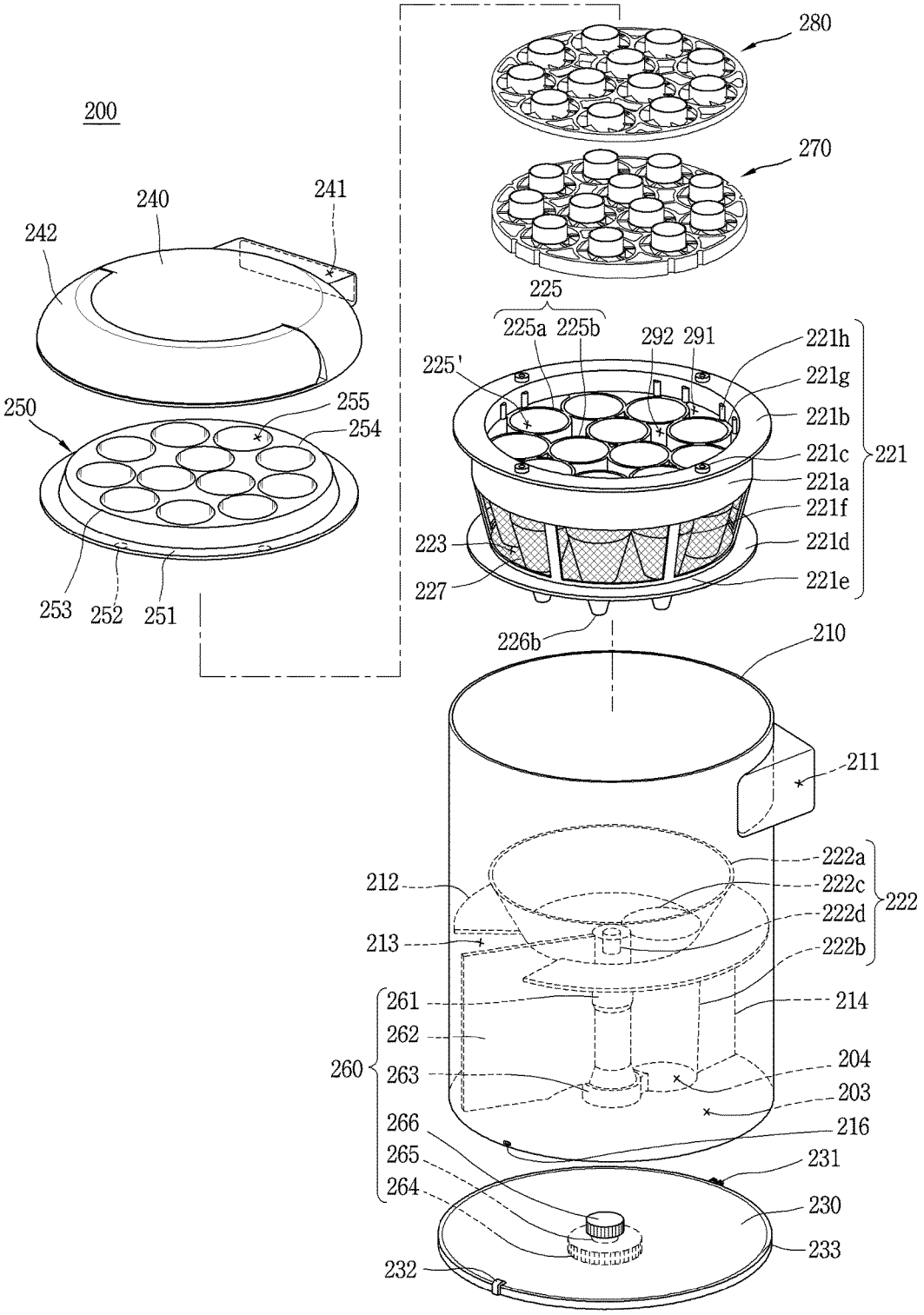
FIG. 6 is a disassembled perspective view of a dust collector according to a second embodiment.
Figure 8:
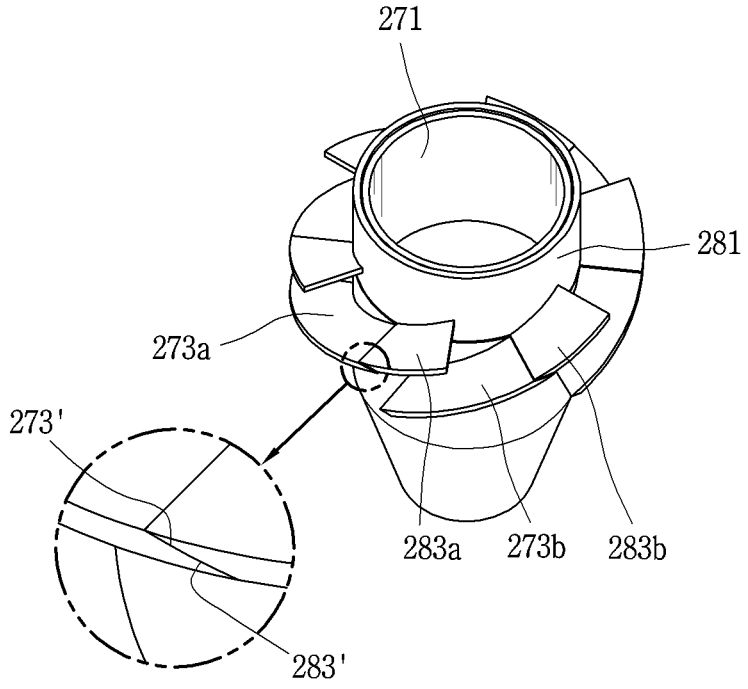
FIG. 8 is a view partially showing a coupled state between the fine dust separating member and the auxiliary member shown in FIG. 6.
Figure 9:
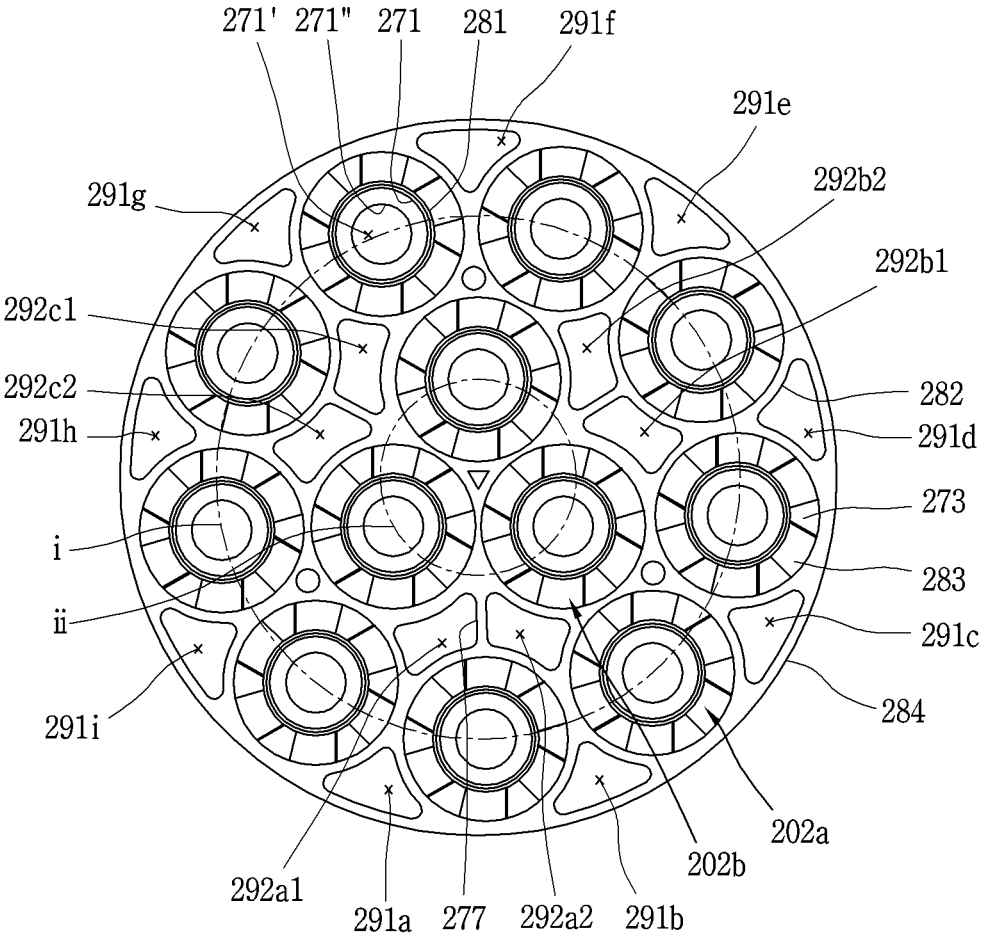
FIG. 9 is a planar view of the fine dust separating member and the auxiliary member shown in FIG. 6.

FIG. 8 is a conceptual view partially showing a coupled state between the fine dust separating member 270 and the auxiliary member 280 shown in FIG. 6. And FIG. 9 is a planar view of the fine dust separating member 270 and the auxiliary member 280 shown in FIG. 6. As the auxiliary member 280 is mounted on the fine dust separating member 270, the auxiliary guide vanes 283 contact guide vanes 273 to thus consecutively extend in a spiral direction. Especially, each of the auxiliary guide vanes 283 may be formed to planar-contact each of the guide vanes 273 (273', 283'). The two surfaces (273', 283') which planar-contact each other may have the same area.

Hereinafter, descriptions will be performed based on one of the guide vanes 273 and one of the auxiliary guide vanes 283. Even if the guide vane 273 and the auxiliary guide vane 283 are provided on different members, they come in planar-contact with each other (273', 283'). Accordingly, the guide vane 273 and the auxiliary guide vane 283 are consecutively extended in a spiral direction as if they are a single vane.

More specifically, referring to FIG. 8, the fine dust separating member 270 includes a first guide vane 273*a* and a second guide vane 273*b*, and the first and second guide vanes 273*a*, 273*b* are arranged close to each other. Likewise, the auxiliary member 280 includes a first auxiliary guide vane 283*a* and a second auxiliary guide vane 283*b*, and the first and second auxiliary guide vanes 283*a*, 283*b* are arranged close to each other.

Once the auxiliary member 280 is mounted on the fine dust separating member 270, the first guide vane 273*a* and the first auxiliary guide vane 283*a* come in planar-contact with each other. Accordingly, the first guide vane 273*a* and the first auxiliary guide vane 283*a* are consecutively extended in a spiral direction as if they are a single vane. The second guide vane 273*b* and the second auxiliary guide vane 283*b* come in planar-contact with each other. Accordingly, the second guide vane 273*b* and the second auxiliary guide vane 283*b* are consecutively extended in a spiral direction as if they are a single vane.

With such a configuration, the vanes may be overlapped with each other in a coupling direction between the fine dust separating member 270 and the auxiliary member 280. More specifically, the first auxiliary guide vane 283*a* and the second guide vane 273*b* are overlapped with each other. The overlapping between the first auxiliary guide vane 283*a* and the second guide vane 273*b* may be seen in FIGS. 8 and 9.

The fine dust separating member 270, manufactured at an upper metallic pattern and a lower metallic pattern by molding, should be separated from the upper and lower metallic patterns after molding. Therefore, the guide vanes 273 cannot be overlapped with each other in an axial direction of the vortex finder 271. The same is applied to the auxiliary member 280. However, if the fine dust separating member 270 and the auxiliary member 280 are coupled to each other, the first auxiliary guide vane 283*a* and the second guide vane 273*b* can be overlapped with each other. This is similar to an overlapping structure between one vane and another vane, in an axial direction of the vortex finder 271 or in a coupling direction between the fine dust separating member 270 and the auxiliary member 280.

Once the first auxiliary guide vane 283*a* and the second guide vane 273*b* are overlapped with each other in a coupling direction between the fine dust separating member 270 and the auxiliary member 280, a vortex of high speed may be formed. This may implement high separation performance of the dust collector 200.

Efficiency and separation performance of the dust collector 200 are in reverse proportion to each other. The dust collector 200 may implement high efficiency through a vortex of low speed, by using the structure of the first embodiment where the set of the axial cyclones is composed of the casings 225 and the fine dust separating member 270. On the contrary, the dust collector 200 may implement high separation performance through a vortex of high speed even if efficiency is a little reduced, by using the structure of the second embodiment where the set of the axial cyclones is composed of the casings 225, the fine dust separating member 270, and the auxiliary member 280.

Since the axial cyclones 202*a*, 202*b* have a circular sectional surface, at least two first passages 291 and at least one passage are formed at a circumference of each of the second group axial cyclones 202*b*. The first passages 291 are formed as two of the first group axial cyclones 202*a* contact the inner cases 221, 222. Accordingly, the first passages 291 are formed in two, on the right and left sides of each of the first group axial cyclones 202*a*.

In order to form second passages 292 between the first group axial cyclones 202*a* and the second group axial cyclones 202*b*, some of the first group axial cyclones 202*a* should contact the second group axial cyclones 202*b*, and others of the first group axial cyclones 202*a* should be spaced part from the second group axial cyclones 202*b*. Referring to FIG. 9, each of the second group axial cyclones 202*b* contacts two among the first group axial cyclones 202*a*. And some of the first group axial cyclones 202*a* are spaced part from the second group axial cyclones 202*b*.

More specifically, referring to FIG. 9, three among the first group axial cyclones 202*a*, and two among the second group axial cyclones 202*b* are disposed to consecutively contact each other in order to form second passages 292*a*1, 292*a*2, 292*b*1, 292*b*2, 292*c*1, 292*c*2. And the centered axial cyclone among the three first group axial cyclones 202*a* is spaced apart from the two second group axial cyclones 202*b*. With such a structure where the axial cyclones partially contact each other and are partially spaced apart from each other, the second passages 292*a*1, 292*a*2, 292*b*1, 292*b*2, 292*c*1, 292*c*2 are formed. Each of the three second passages 292*a*, 292*b*, 292*c* is divided into two regions 292*a*1, 292*a*2, 292*b*1, 292*b*2, 292*c*1, 292*c*2, by a bridge 277.

In certain implementations, a ratio (a/b) between a sum (a) of sectional areas of first passages 291*a*, 291*b*, 291*c*, 291*d*, 291*e*, 291*f*, 291*g*, 291*h*, 291*i* and a sum (b) of sectional areas of the second passages 292*a*1, 292*a*2, 292*b*1, 292*b*2, 292*c*1, 292*c*2 is within a range of 0.75~1.25. The sectional areas of the first passages 291*a*, 291*b*, 291*c*, 291*d*, 291*e*, 291*f*, 291*g*, 291*h*, 291*i* and the sectional areas of the second passages 292*a*1, 292*a*2, 292*b*1, 292*b*2, 292*c*1, 292*c*2 mean areas of the respective passages shown on a planar view of the secondary cyclone unit 202.

Referring to FIG. 9, the sum of the sectional areas of the total 9 first passages 291*a*, 291*b*, 291*c*, 291*d*, 291*e*, 291*f*, 291*g*, 291*h*, 291*i* was calculated as about 600 $mm^2$. And the sum of the sectional areas of the total 3 second passages 292*a*1, 292*a*2, 292*b*1, 292*b*2, 292*c*1, 292*c*2 was calculated as about 760 $mm^2$. Accordingly, a total area of the first passages 291*a*, 291*b*, 291*c*, 291*d*, 291*e*, 291*f*, 291*g*, 291*h*, 291*i* and the second passages 292*a*1, 292*a*2, 292*b*1, 292*b*2, 292*c*1, 292*c*2 was calculated as 1360 $mm^2$, and the ratio (a/b) was calculated as about 0.789.

The axial cyclones 202*a*, 202*b* have characteristics that an inflow is generated in an axial direction and a vortex thereof is formed by the guide vanes 273. Accordingly, the axial cyclones 202*a*, 202*b* preferably have a structure that an inflow is generated uniformly in all directions. The reason is because a flow area of the axial cyclones 202*a*, 202*b* is not utilized and a flow loss occurs, if an inflow is not uniformly formed.

In order to uniformly form an inflow in all directions of the axial cyclones 202*a*, 202*b*, the ratio (a/b) between the sum (a) of the sectional areas of the first passages 291*a*, 291*b*, 291*c*, 291*d*, 291*e*, 291*f*, 291*g*, 291*h*, 291*i* and the sum (b) of the sectional areas of the second passages 292*a*1, 292*a*2, 292*b*1, 292*b*2, 292*c*1, 292*c*2 is preferably about 1. If the ratio (a/b) is 1, a uniform inflow may be generated most ideally. And if the ratio (a/b) is within the range of 0.75~1.25, a uniform inflow may be generated sufficiently.

In this specification, the same or equivalent components have been provided with the same or similar reference numbers. Accordingly, reference numbers of components depicted in FIGS. 6 to 9 will be understood by the descriptions of similar components depicted in FIGS. 1A to 5.

The second embodiment is differentiated from the first embodiment in that the dust collector includes an auxiliary member 280. Accordingly, descriptions except for the auxiliary member, in the first or second embodiment, may be also applied to other embodiments. Unlike the first or second embodiment, this embodiment may have a configuration that eight first group axial cyclones are formed and four second group axial cyclones are formed. In this case, each of the four second group axial cyclones is arranged to contact two among the eight first group axial cyclones.

The number of the first group axial cyclones, and the number of the second group axial cyclones may be variable according to a design of the dust collector and the vacuum cleaner. However, even if the number of the axial cyclones is changed, a ratio between the sum of the sectional areas of the first passages and the sum of the sectional areas of the second passages should be designed to be within the range of the range of 0.75~1.25, as aforementioned.

The configurations and methods of the dust collector and the cleaner having the same in the aforesaid embodiments may not be limitedly applied, but such embodiments may be configured by a selective combination of all or part of the embodiments so as to implement many variations. With such a configuration, the plurality of first passages are formed between the first group axial cyclones which belong to the secondary cyclone unit and the inner cases, and the plurality of second passages are formed between the first group axial cyclones and the second group axial cyclones. Since the ratio (a/b) between the sum (a) of the sectional areas of the first passages and the sum (b) of the sectional areas of the second passages is within the range of 0.75~1.25, a vortex may be uniformly introduced into each of the axial cyclones in all directions.

Further, since the bridges are connected to the first group axial cyclones and the second group axial cyclones by crossing the second passages, concentration of a vortex to one region inside the single second passage may be prevented. As the bridge is formed at each of the second passages to divide the single second passage into two regions, a vortex uniformly passes through the second passage without being concentrated onto one region. Accordingly, a vortex may be uniformly introduced into each of the axial cyclones in all directions.

In certain implementations, the ratio (h/d) of the height (h) and the diameter (d) of the axial cyclones is designed to be within a range of 3~5, for optimized separation performance of the axial cyclones. In certain implementations, the vortex finders, the band portions, and the guide vanes are formed as an integrated member (fine dust separating member), and the casings and the integrated member are coupled in the axial cyclones. This may solve problems, such as lowering of separation performance and difficult processes of a dust collector, due to the conventional method for manufacturing axial cyclones in a separated manner.

Further, in certain implementations, since the band portions and the guide vanes of the integrated member are connected to each other, lowering of separation performance due to a gap may be solved. Likewise, lowering of separation performance due to a gap between the guide vanes may be also solved through an overlapping structure between two integrated members, i.e., the fine dust separating member and the auxiliary member.

Further, in certain implementations, the dust collector may have facilitated assembly processes through a coupling structure between the fine dust separating member and the inner case implemented by the position fixing protrusion and the position fixing groove, and through a coupling structure between the fine dust separating member and the auxiliary member implemented by the vortex finders and the cover portions. Further, in certain implementations, the dust collector may have enhanced efficiency through the fine dust separating member, and may have enhanced separation performance through the auxiliary member.

Therefore, certain implementations may provide a dust collector capable of forming a uniform inflow at a plurality of axial cyclones. Certain implementations may also provide a dust collector which includes axial cyclones having a size large enough to maximize separation performance of the dust collector. Certain implementations may further provide a dust collector which includes a plurality of axial cyclones formed by an integrated member, in order to solve lowering of separation performance, difficult processes, etc. due to the conventional method for manufacturing axial cyclones in a separated manner.

Certain implementations may provide a dust collector which includes axial cyclones having a structure where an outer side wall of a secondary cyclone unit and guide vanes are connected to each other, in order to solve lowering of separation performance of the dust collector, due to a gap between the outer side wall and the guide vanes. Certain implementations may also provide a dust collector which includes axial cyclones having a structure where guide vanes are overlapped with each other in one direction, in order to solve lowering of separation performance of the dust collector, due to a gap between the guide vanes.

Certain implementations may provide a coupling structure between an integrated member and a case, the integrated member formed to simplify an assembly process of axial cyclones. Certain implementations may also provide a dust collector having an integrated auxiliary member which supplements separation performance of an integrated member.

The dust collector in certain implementations may include an outer case, an inner case, and a cyclone unit formed by a set of axial cyclones which separate fine dust from air introduced in an axial direction. The set of the axial cyclones includes a first group and a second group. The first group axial cyclones are disposed along a circumference of a first circle so as to contact an inner circumferential surface of the inner case, and are partially spaced apart from the inner case to form a plurality of first passages therebetween.

The second group axial cyclones are disposed to contact each other along a circumference of a second circle concentric with the first circle and smaller than the first circle. And the second group axial cyclones are formed to partially contact the first group axial cyclones and to be partially spaced apart from the first group axial cyclones to form a plurality of second passages therebetween.

Bridges are connected to the first group axial cyclones and the second group axial cyclones by crossing the second passages. One end of the bridge is connected to one of the first group axial cyclones, and another end of the bridge is connected to two of the second group axial cyclones. A ratio (a/b) between a sum (a) of sectional areas of the first passages and a sum (b) of sectional areas of the second passages may be within a range of 0.75~1.25. A ratio (h/d) between a height (h) and a diameter (d) of the axial cyclones may be within a range of 3~5.

The dust collector of certain implementations includes a first embodiment having a fine dust separating member, or a second embodiment having a fine dust separating member and an auxiliary member. A dust collector according to a first embodiment includes a cyclone unit formed by a set of axial cyclones configured to separate fine dust from air introduced in an axial direction, and the set of the axial cyclones is formed by coupling between casings and a fine dust separating member. The fine dust separating member is a single member (or an integrated member) including vortex finders, band portions and guide vanes. Certain implementations have a characteristic that the set of the axial cyclones is formed as the fine dust separating member (single member) is coupled to casings.

Such a characteristic is differentiated from the conventional structure where a vortex finder having guide vanes is coupled to a casing in order to manufacture axial cyclones in a separated manner, and then the individual axial cyclones are assembled to each other to form a set of the axial cyclones. In certain implementations, since the fine dust separating member (single member) includes vortex finders, band portions and guide vanes, a set of axial cyclones is formed by merely coupling the fine dust separating member with casings. And an assembly process for dust collector 100 that is simpler than the assembly process for the conventional collector may be implemented in certain implementations.

The vortex finders of the fine dust separating member are disposed in the casings, and each of the casings forms an outer wall around a hollow portion. Accordingly, it may be understood that the vortex finders are arranged at the hollow portions of the casings.

The band portions are formed to enclose an outer circumferential surface of the vortex finders, at a position spaced apart from the vortex finders. The band portions are mounted on the casings, and have a shape corresponding to the casings in order to form outer walls of the axial cyclones, together with the casings. Even if the band portions and the casings are separated components, they form outer walls of the axial cyclones together as if they are single components, because they have shapes corresponding to each other. Since the band portions are spaced apart from the vortex finders and have a shape corresponding to the casings, it may be understood that the casings are also spaced apart from the vortex finders.

Finally, the guide vanes are disposed between the vortex finders and the band portions to be connected to the vortex finders and the band portions, and extend in a spiral direction. Thus, the vortex finders and the band portions spaced apart from each other are connected to each other by the guide vanes, and it may be understood that the outer walls of the axial cyclones and the vortex finders are connected to each other by the guide vanes.

The axial cyclone of certain implementations is differentiated from the conventional axial cyclone. In the conventional axial cyclone, since vortex finders and outer walls of the axial cyclone are spaced apart from each other, separation performance is lowered due to a gap therebetween. On the other hand, in the axial cyclone of certain implementations described herein, since the vortex finders and the outer walls of the axial cyclone are connected to each other by the guide vanes, there is no gap therebetween and thus separation performance is not lowered. Accordingly, the axial cyclone of certain implementations has more enhanced separation performance than the conventional axial cyclone.

The axial cyclone of certain implementations may have a primary cyclone unit and a secondary cyclone unit. The primary cyclone unit is formed to separate dust from air introduced from the outside, and the secondary cyclone unit is formed by a set of a plurality of axial cyclones and is configured to separate fine dust from air. The concept of a multi-cyclone including the primary cyclone unit and the secondary cyclone unit may be introduced.

One side of the guide vanes may be connected to an outer circumferential surface of the vortex finders in a spiral direction, and another side of the guide vanes may be connected to an inner circumferential surface of the band portions in a spiral direction. The guide vanes may extend from a lower end of the band portions to an upper end of the band portions in a spiral direction, so as to have the same height as the band portions. Under such a structure, since there is no gap between the guide vanes and the band portions, lowering of separation performance due to a gap may be prevented.

The fine dust separating member includes an outer band portion, and the outer band portion is formed to enclose the band portions of the first group axial cyclones to thus form an edge of the fine dust separating member. And the outer band portion is connected to the band portions of the first group axial cyclones. Since a passage of air and fine dust is formed between the band portions of the first group axial cyclones and the outer band portion, air and fine dust can be introduced into the secondary cyclone unit from the primary cyclone unit without an additional passage structure. The outer band portion forms an outer wall of the secondary cyclone unit together with the casings. The outer band portion may be selectively formed according to a design. However, it is preferable that the fine dust separating member includes the outer band portion, for a stable coupling between the inner case and the fine dust separating member.

The dust collector includes an outer case and an inner case, and the fine dust separating member is formed to be mountable to the inner case. The outer case forms appearance of the dust collector and an outer wall of the primary cyclone unit. The inner case is installed in the outer case so as to enclose the casings and the outer band portion, and is provided with a stair-stepped portion formed along an inner circumferential surface thereof in order to support the outer band portion.

Since the casings are fixed to the inner case, a relative rotation between the fine dust separating member and the inner case means a relative rotation between the fine dust separating member and the casings. Accordingly, if the fine dust separating member is relatively rotated with respect to the inner case, a structure of the axial cyclones is transformed. The fine dust separating member is mounted to the stair-stepped portion, and any relative rotation between the fine dust separating member and the inner case is prevented by a position fixing groove and a position fixing protrusion.

A dust collector according to a second embodiment includes a fine dust separating member and an auxiliary member, and a set of axial cyclones is formed by casings, the fine dust separating member and the auxiliary member. The casings and the fine dust separating member are the same as those of the first embodiment, and the auxiliary member is configured to assist a function of the fine dust separating member.

The auxiliary member is mounted on the fine dust separating member, and includes cover portions, auxiliary band portions, and auxiliary guide vanes. The cover portions are configured to prevent coupling and a relative rotation between the auxiliary member and the fine dust separating member, and are formed to enclose an outer circumferential surface of the vortex finders. Since the cover portions are formed to enclose the outer circumferential surface of the vortex finders, it may be understood that the cover portions form an outer wall of the vortex finders.

The auxiliary band portions are configured to assist the band portions of the fine dust separating member, and are formed to enclose an outer circumferential surface of the cover portions at a position spaced apart from the cover portions. And the auxiliary band portions have a shape corresponding to the band portions so as to form outer walls of the axial cyclones together with the casings and the band portions by being mounted on the band portions. Even if the band portions, the auxiliary band portions, and the casings are separated components, they form the outer walls of the axial cyclones together as if they are single components, because they have shapes corresponding to each other.

Finally, the auxiliary guide vanes, configured to assist the guide vanes of the fine dust separating member, have one side connected to an outer circumferential surface of the cover portions in a spiral direction, and have another side connected to an inner circumferential surface of the auxiliary band portions in a spiral direction. The cover portions and the auxiliary band portions spaced apart from each other are connected to each other by the auxiliary guide vanes. Accordingly, it may be understood that outer walls of the axial cyclones and outer walls of the vortex finders are connected to the auxiliary guide vanes.

Like the fine dust separating member, the auxiliary guide vanes contact the guide vanes, and consecutively extend in a spiral direction. The auxiliary guide vanes are formed to come in planar-contact with the guide vanes. Even if the fine dust separating member and the auxiliary member are separate members, the guide vanes of the fine dust separating member and the auxiliary guide vanes of the auxiliary member form guide vanes of the axial cyclones as if they are single components, because the auxiliary guide vanes and the guide vanes consecutively extend in a spiral direction and they come in planar-contact with each other.

Accordingly, an overlapping structure not implemented from a single component manufactured from a metallic pattern can be implemented. The guide vanes include a first guide vane and a second guide vane arranged close to each other. And the auxiliary guide vanes include: a first auxiliary guide vane contacting the first guide vane, and consecutively extended in a spiral direction; and a second auxiliary guide vane contacting the second guide vane, and consecutively extended in a spiral direction. The first auxiliary guide vane and the second auxiliary guide vane are overlapped with each other in a coupling direction between the fine dust separating member and the auxiliary member. With such an overlapping structure, a vortex of high speed may be formed, and high separation performance of the dust collector may be implemented.

The fine dust separating member is provided with supporting portions which form stair-stepped portions along an outer circumferential surface of the vortex finders, and the cover portions have a shape corresponding to the supporting portions, so as to be mounted to the supporting portions. With such a structure, the fine dust separating member and the auxiliary member may be coupled to each other.

The fine dust separating member is formed to be thicker than the auxiliary member. A thickness of the fine dust separating member and the auxiliary member influences on separation performance and efficiency of the dust collector. The auxiliary member serves to assist the fine dust separating member, and has lowered efficiency due to a pressure loss when the auxiliary member is formed to be excessively thick. Thus, the auxiliary member is preferably formed to be thinner than the fine dust separating member. On the other hand, the fine dust separating member serves to separate fine dust from air, and is preferably formed to be thicker than the auxiliary member for high separation performance.

The dust collector of certain implementations may implement an embodiment extended from the first and second embodiments. A primary cyclone unit of the dust collector is formed by an outer case, an inner case, and a mesh filter. The outer case forms appearance of the dust collector, and forms an outer wall of the primary cyclone unit. The inner case is disposed at an inner side of the outer case, and forms an inner wall of the primary cyclone unit. Since the secondary cyclone unit is disposed at an inner side of the inner case, the inner case forms a boundary between the primary cyclone unit and the secondary cyclone unit. The mesh filter is installed to cover openings of the inner case, and the mesh filter also forms the boundary between the primary cyclone unit and the secondary cyclone unit.

The inner case may be formed as a single member or at least two members. In a case where the inner case is formed as two members, a first member includes a lateral boundary portion formed to enclose at least part of the secondary cyclone unit; an upper boundary portion which extends in a circumferential direction, from an upper end of the lateral boundary portion to an inner circumferential surface of the outer case; a skirt portion which extends in a circumferential direction, from a lower end of the first member towards the inner circumferential surface of the outer case; a plate portion formed inside the skirt portion; and connection portions configured to connect the lateral boundary portion and the skirt portion with each other.

A second member may include an accommodation portion configured to accommodate therein a fine dust outlet of the axial cyclones; and a dust collecting portion boundary which forms a boundary between a first dust collecting portion and a second dust collecting portion. The mesh filter is coupled to an opening formed between the lateral boundary portion and the skirt portion, and is formed to have a net shape or a porous shape. Dust and fine dust may be distinguished from each other in weight, by separation performance of the primary cyclone unit and the secondary cyclone unit. And dust and fine dust may be distinguished from each other in size, by the mesh filter.

The secondary cyclone unit may be formed by the set of the aforementioned axial cyclones. The axial cyclones may be disposed inside the primary cyclone unit, or may be radially disposed along an outer circumferential surface of the primary cyclone unit.

The dust collector includes a first dust collecting portion configured to collect dust separated from air by the primary cyclone unit, and a second dust collecting portion configured to collect fine dust separated from air by the secondary cyclone unit. The first dust collecting portion may be defined by a partitioning portion and an accommodating portion which form an upper side wall thereof, an outer case which forms an outer wall thereof, a dust collecting portion boundary which forms an inner wall thereof, and a lower cover which forms a bottom surface thereof. The partitioning portion is formed along an inner circumferential surface of the outer case. An upper region of the partitioning portion is defined as the primary cyclone unit, and a lower region of the partitioning portion is defined as the first dust collecting portion.

A pressing unit is installed at the first dust collecting portion to compress dust collected at the first dust collecting portion. The pressing unit includes a rotation shaft, a pressing member, a fixing portion, a first driven gear, a power transmission rotation shaft, and a second driven gear. A driving force generated from the driving motor of the cleaner body is transmitted to the first driven gear of the dust collector through the driving gear of the cleaner body. Then, the driving force is sequentially transmitted to the rotation shaft through the power transmission rotation shaft and the second driven gear. As the rotation shaft is rotated, dust is compressed.

The second dust collecting portion is defined by a dust collecting portion boundary which forms a side wall thereof, and a lower cover which forms a bottom surface thereof. A pressing unit may be installed in the second dust collecting portion according to a design. And the pressing unit installed in the second dust collecting portion may be configured to share a driving force with the pressing unit installed in the first dust collecting portion.

This application is related to U.S. application Ser. No. 15/487,756 filed on Apr. 14, 2017, whose entire disclosure is incorporated herein by reference.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to change or modify such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dust collector, comprising:

an outer case;

an inner case disposed at an inner side of the outer case;

a first cyclone formed by the outer case and the inner case, and configured to separate first foreign materials from air introduced from outside; and a secondary cyclone installed at an inner side of the inner case to separate second foreign materials from air which has passed through the first cyclone, the first foreign materials having a larger dimension than the second foreign materials, the secondary cyclone having a set of axial cyclones, wherein the set includes:

first axial cyclones including a plurality of first inverted hollow cones having open top and bottom and a cyclonic airflow is provided in an axial direction of the first inverted hollow cones from the open top, a center of the each first axial cyclone being disposed along a circumference of a first circle and the first axial cyclones contacting an inner circumferential surface of the inner case, and formed to be partially spaced apart from the inner circumferential surface of the inner case to form a plurality of first passages therebetween; and second axial cyclones including a plurality of second inverted hollow cones having open top and bottom and a cyclonic airflow is provided in an axial direction of the second inverted hollow cones from the open top, adjacent axial cyclones are disposed to contact each other and a center of each second axial cyclone is provided along a circumference of a second circle, the second circle being concentric with the first circle and smaller than the first circle, and formed to partially contact the first axial cyclones and to be partially spaced apart from the first axial cyclones to form a plurality of second passages therebetween.

2. The dust collector of claim 1, wherein each of the second axial cyclones is disposed to contact at least two of the first axial cyclones.

3. The dust collector of claim 1, wherein some of the first axial cyclones are spaced apart from the second axial cyclones.

4. The dust collector of claim 1, wherein three among the first axial cyclones, and two among the second axial cyclones are disposed to consecutively contact each other in order to form the second passages.

5. The dust collector of claim 1, further comprising bridges connected to the first axial cyclones and the second axial cyclones by crossing the second passages.

6. The dust collector of claim 5, wherein the bridge is formed at each of the second passages.

7. The dust collector of claim 5, wherein one end of the bridge is connected to one of the first axial cyclones, and another end of the bridge is connected to two of the second axial cyclones.

8. The dust collector of claim 1, wherein a ratio (a/b) between a sum (a) of sectional areas of the first passages and a sum (b) of sectional areas of the second passages is within a range of 0.75~1.25.

9. The dust collector of claim 1, wherein the number of the first axial cyclones is 9, and the number of the second axial cyclones is 3, and each of the three second axial cyclones is disposed to contact two among the first axial cyclones.

10. The dust collector of claim 1, wherein the number of the first axial cyclones is 8, and the number of the second axial cyclones is 4, and each of the four second axial cyclones is disposed to contact two among the first axial cyclones.

11. The dust collector of claim 1, wherein at least two first passages and at least one second passage are formed at a circumference of each of the first axial cyclones.

12. The dust collector of claim 1, wherein the axial cyclones include:

casings which form outer walls around hollow portions, and having a shape narrowed toward a lower side;

vortex finders disposed inside the casings; and guide vanes formed on an outer circumferential surface of the vortex finders, and extended in a spiral direction, wherein a ratio (h/d) between a height (h) from a lower end of the casings to an upper end of the guide vanes, and a maximum diameter (d) of the casings is within a range of 3~5.

13. The dust collector of claim 1, wherein the set further includes:

vortex finders protruding from the first and second inverted hollow cones;

inner bands formed to enclose an outer circumferential surface of the vortex finders at a position spaced from the vortex finders, and having a shape corresponding to the first and second inverted hollow cones so as to form outer walls of the first and second axial cyclones; and guide vanes disposed between the vortex finders and the inner bands, connected to the vortex finders and the inner bands, and extended in a spiral direction.

14. The dust collector of claim 13, wherein one side of the guide vanes is connected to the outer circumferential surface of the vortex finders in a spiral direction, and another side thereof is connected to an inner circumferential surface of the inner bands in a spiral direction.

15. The dust collector of claim 13, wherein the set further comprises an outer band formed to enclose the inner bands of the first axial cyclones and forming an edge of the secondary cyclone, the outer band being connected to the inner bands of the first axial cyclones.

16. The dust collector of claim 13, further comprising sleeves formed to enclose the outer circumferential surface of the vortex finders;

auxiliary inner bands formed to enclose an outer circumferential surface of the sleeves at a position spaced from sleeves, and having a shape corresponding to the inner bands and the auxiliary inner bands being mounted on the inner bands; and auxiliary guide vanes having one side connected to the outer circumferential surface of the sleeves in a spiral direction, and having another side connected to an inner circumferential surface of the auxiliary inner bands in a spiral direction.

17. The dust collector of claim 16, wherein the auxiliary guide vanes contact the guide vanes to be consecutively extended in a spiral direction.

18. The dust collector of claim 16, wherein each of the auxiliary guide vanes contacts each of the guide vanes, and a contact surface between corresponding guide vane and the auxiliary guide vane is planar.

19. The dust collector of claim 16, wherein the guide vanes include a first guide vane and a second guide vane arranged close to each other, wherein the auxiliary guide vanes include:

a first auxiliary guide vane contacting the first guide vane, and consecutively extended in a spiral direction; and a second auxiliary guide vane contacting the second guide vane, and consecutively extended in a spiral direction, wherein the first auxiliary guide vane and the second auxiliary guide vane are overlapped with each other in a coupling direction.

20. A dust collector, comprising:

a case; and a cyclone installed at an inner side of the case to separate foreign materials from air introduced into the case, the cyclone having a set of axial cyclones, wherein the set includes:

first axial cyclones including a plurality of first inverted hollow cones having open top and bottom and a cyclonic airflow is provided in an axial direction of the first inverted hollow cones from the open top, a center of the each first axial cyclone being disposed along a circumference of a first circle and the first axial cyclones contacting an inner circumferential surface of the case; and second axial cyclones including a plurality of second inverted hollow cones having open top and bottom and the cyclonic airflow is provided in an axial direction of the second inverted hollow cones from the open top, adjacent axial cyclones are disposed to contact each other and a center of each second axial cyclone is provided along a circumference of a second circle, the second circle being concentric with the first circle and smaller than the first circle, and second axial cyclones being formed to partially contact the first axial cyclones.

* * * * *